US006469674B1

(12) United States Patent
Podger

(10) Patent No.: US 6,469,674 B1
(45) Date of Patent: Oct. 22, 2002

(54) DOUBLE-LEMNISCATE ANTENNA ELEMENT

(76) Inventor: James Stanley Podger, 55 Gradwell Drive, Scarborough, Ontario (CA), M1M 2N1

( * ) Notice: Subject to any disclaimer, the term of this patent is extended or adjusted under 35 U.S.C. 154(b) by 0 days.

(21) Appl. No.: 09/907,924

(22) Filed: Jul. 19, 2001

(30) Foreign Application Priority Data

May 17, 2001 (CA) ..... 2347596

(51) Int. Cl.[7] ..... H01Q 11/12
(52) U.S. Cl. ..... 343/742; 343/792.5; 343/867
(58) Field of Search ..... 343/741, 742, 343/792.5, 866, 867, 731, 732, 737, 797

(56) References Cited

U.S. PATENT DOCUMENTS

| | | | | | |
|---|---|---|---|---|---|
| 2,190,816 | A | * | 2/1940 | Wheeeler | 343/742 |
| 3,210,767 | A | | 10/1965 | Isbell | |
| 3,434,145 | A | * | 3/1969 | Wells | 343/726 |
| 4,701,764 | A | * | 10/1987 | Malcombe | 343/742 |
| 4,972,198 | A | * | 11/1990 | Feltz et al. | 340/572.7 |
| 5,103,234 | A | * | 4/1992 | Watkins et al. | 340/572.7 |
| 5,103,235 | A | * | 4/1992 | Clemens | 340/572.7 |
| 5,142,292 | A | * | 8/1992 | Chang | 340/572.3 |
| 5,404,147 | A | * | 4/1995 | Drucker et al. | 340/572.7 |
| 5,790,082 | A | * | 8/1998 | Podger | 343/792.5 |
| 5,805,114 | A | | 9/1998 | Podger | |
| 5,966,100 | A | | 10/1999 | Podger | |
| 5,969,687 | A | * | 10/1999 | Podger | 343/742 |
| 5,995,060 | A | | 11/1999 | Podger | |
| 6,020,857 | A | * | 2/2000 | Podger | 343/742 |
| 6,057,803 | A | * | 5/2000 | Kane et al. | 343/713 |
| 6,255,998 | B1 | | 7/2001 | Podger | |
| 6,333,717 | B1 | * | 12/2001 | Podger | 343/741 |

OTHER PUBLICATIONS

Kraus, John D., "A Small But Effective 'Flat Top' Beam," *Radio*, Mar. 1937, pp. 56–58, U. S. A.
Podger, J. S., Analysis Results, *Quadruple Delta*.
Podger, J. S., Analysis Results, *Expanded Quadruple Delta*.
Podger, J. S., Analysis Results, *Double Lemniscate*.
Podger, J. S., Analysis Results, *Expanded Double Lemniscate*.
Podger, J. S., Analysis Results, *Combination Quad Delta and Lemniscate*.

* cited by examiner

*Primary Examiner*—Hoanganh Le
*Assistant Examiner*—Shih-Chao Chen

(57) ABSTRACT

An antenna element that has four coplanar and aligned loops, of approximately one-wavelength to two-wavelength perimeters, that have shapes that are similar to the mathematical curve called a lemniscate. Variations of the basic shape, related combinations of lemniscate and triangular loops, plus applications of the antenna element also are disclosed.

59 Claims, 9 Drawing Sheets

DOUBLE-LEMNISCATE ANTENNA ELEMENT

This is the U. S. version of Canadian patent application 2,347,596.

FIELD OF THE INVENTION

This invention relates to antenna elements, specifically antenna elements that are combinations of four coplanar one-wavelength to two-wavelength loops. Such antenna elements can be used alone or in combinations to serve many antenna needs. One object of the invention is to achieve a superior transmitting and receiving ability in some desired direction. Particularly, an object is to enhance that ability at elevation angles close to the horizon. Another object is to decrease the transmitting and receiving ability in undesired directions. Yet another object is to produce antennas that operate satisfactorily over greater ranges of frequencies.

SUMMARY OF THE INVENTION

Previous disclosures have shown that pairs of one-wavelength triangular loops perform better than pairs of loops of the other shapes used in the past. Another previous disclosure showed that pairs of loops shaped similar to the curve that mathematicians call a lemniscate perform better than triangular loops. Two other disclosures showed than combinations of four triangular loops perform better than pairs of triangular loops. The present disclosure shows that combinations of four loops having lemniscate-shaped curves perform better than combinations of four triangular loops. These antenna elements will hereinafter be called double-lemniscate antenna elements.

LIST OF DRAWINGS

The background of this invention as well as the objects and advantages of the invention will be apparent from the following description and appended drawings, wherein.

PRIOR ART

Prior Art—Loop Antennas

The development of antenna elements based on loops of conductors having perimeters of one wavelength has recently progressed from older shapes, such as squares and circles, to combinations of triangles, such as in the applicant's U.S. Pat. Nos. 5,966,100, entitled Quadruple-Delta Antenna Structure, and 5,805,114, entitled Expanded Quadruple-Delta Antenna Structure. More recently, the merit of loops having the shape of the mathematical curve called a lemniscate was disclosed in the applicant's U.S. Pat. No. 6,255,998 entitled Lemniscate Antenna Element.

Figure 2:
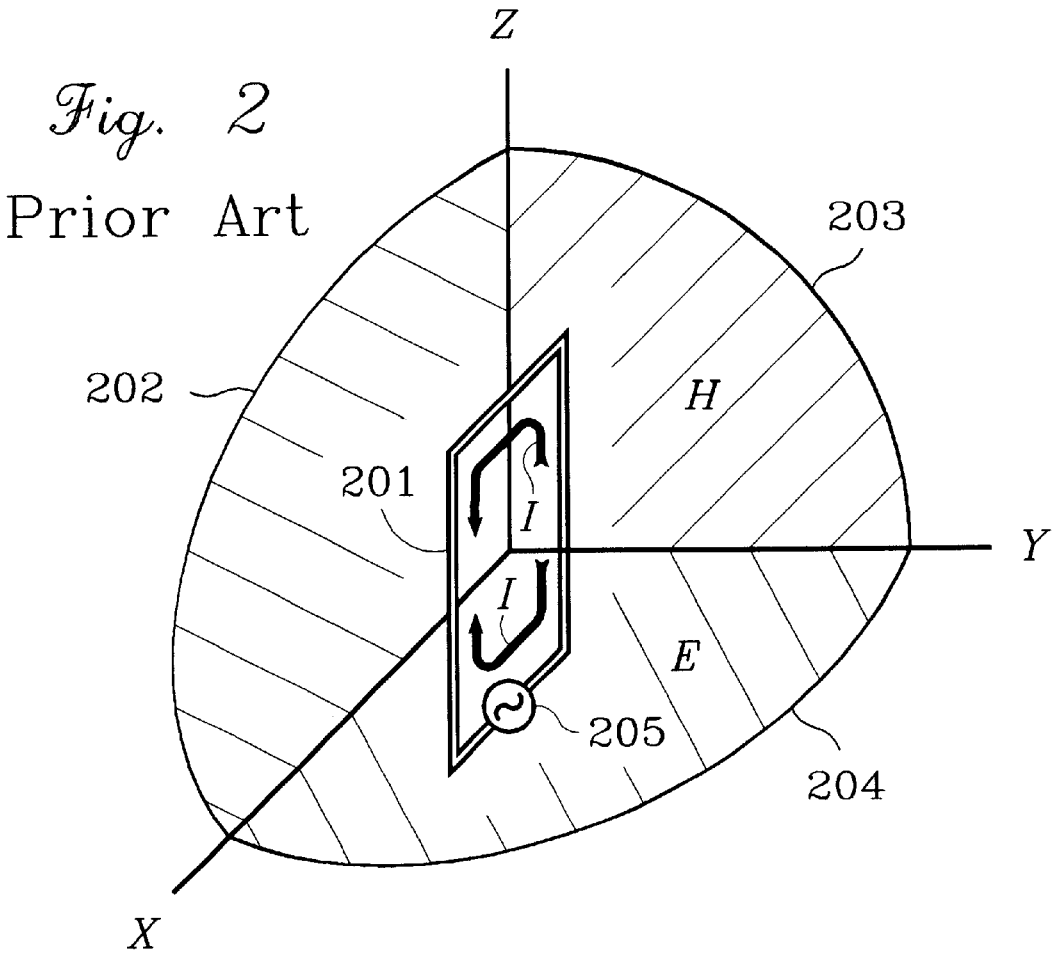
Fig. 2 Prior Art
FIG. 2 illustrates the conventional principal planes passing through a rectangular loop antenna.

One advantage of all of these loop antenna elements, relative to half-wave dipoles, is that they are less susceptible to receiving noise caused by precipitation. Another advantage is that they have directivity in the plane perpendicular to the major current-carrying conductors. FIG. 2, having parts 201 to 205, illustrates this plane, 203. Hereinafter in this description and the attached claims, this plane will be called the principal H plane, as is conventional practice. Hereinafter in this description and the attached claims, the plane, 204, that is perpendicular to the principal H plane and the plane, 202, of the loop, 201, will be called the principal E plane, as is conventional practice.

Figure 1A:
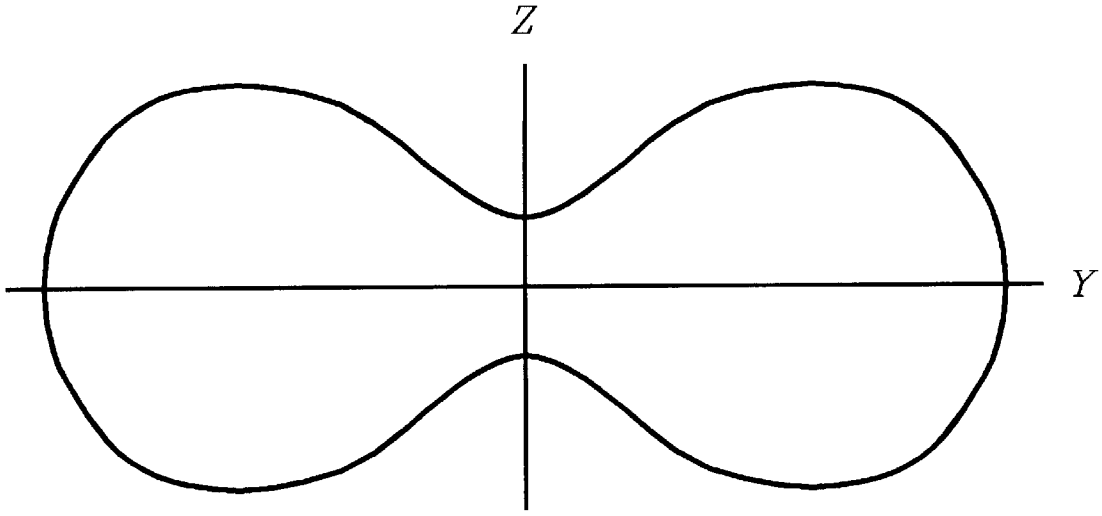
Prior Art Fig. 1A
FIGS. 1A, 1B and 1C illustrate some possible, simplified radiation patterns of antennas.

The amount of directivity that can be achieved with single loops is modest and similar to that illustrated by the radiation pattern of FIG. 1A. With more loops, the radiation pattern can be similar to that illustrated by FIG. 1B or 1C. Not only are such radiation patterns beneficial for the gain in the desired directions, but they also are beneficial for reducing the performance in undesired directions. In addition, if the principal H plane were vertical (horizontal polarization), these antenna elements would tend to perform well at low elevation angles. This is important at very-high and ultra-high frequencies because received signals usually arrive at low elevation angles. This also is important at high frequencies because long-distant signals usually arrive at low elevation angles and they usually are the weaker signals.

In addition to the lines representing the conductors, there are wide arrows in FIGS. 2, 4, 5, 6, and 7 to indicate some aspects of the currents. That is, these arrows indicate that current maxima are at the centres of the arrows, current minima are where the arrowheads and arrow tails face each other, and the current maxima are very approximately out of phase with each other at adjacent arrows of particular current paths. However, not much else should be assumed about these currents. Particularly, it should not be assumed that different currents necessarily have the same magnitudes and phases just because they are all called I or that there are sudden changes in phase where the arrowheads and arrow tails face each other.

Prior Art—The Lemniscate Curve

Figure 3:
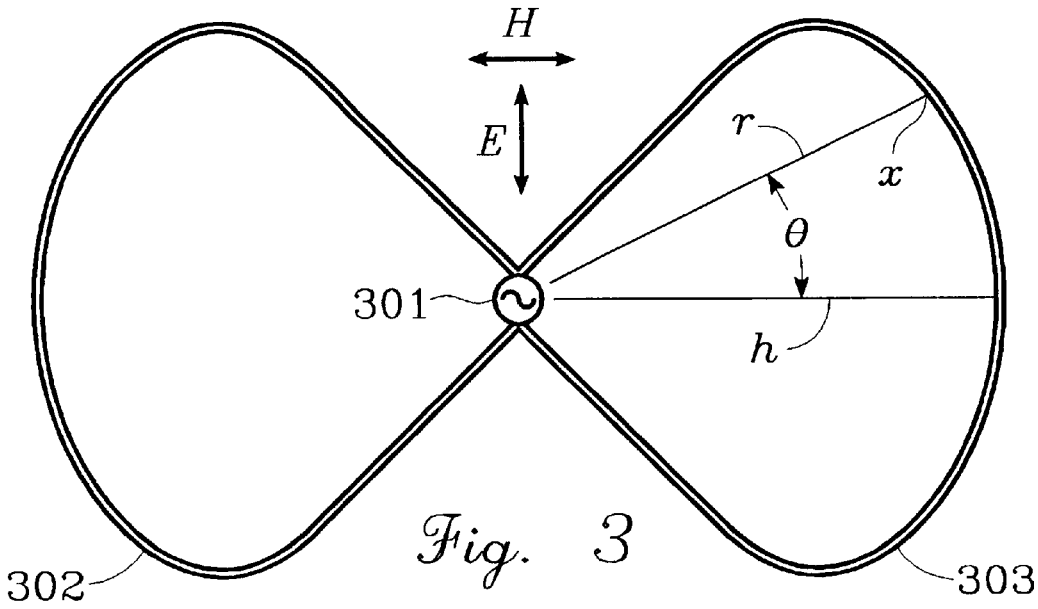
Fig. 3 Prior Art
FIG. 3 illustrates the basic nature of the lemniscate curve.

FIG. 3, with the generator symbol, 301, feeding the two conducting loops, 302 and 303, illustrates the basic shape of the loops in this invention. Note that the generator is connected from one side of both loops to the other side of both loops. That is, it is connected in series with both of the loops. It is definitely not connected between one loop and the other loop, which would change the current patterns and make the structure a type of dipole.

Although this double-loop antenna element is not the invention, it is enlightening to review the nature of these loop shapes. Although an advantage over triangular loops can be achieved by simply bowing outward the outer sides of the triangles, it is convenient for mathematical analysis to express the shape by a mathematical formula. The curve known by mathematicians as a lemniscate serves this purpose very well because, by changing the parameters, it can produce a wide variety of curves that are not only similar to the curve of FIG. 3 but that describe antenna elements that are desirable.

The reason for considering the lemniscate for a double-loop antenna element is because it is similar in an important respect to the triangle. The advantage of both triangles and lemniscates seems to be based on a superior distribution of the major radiating parts of the loops. That is, the radiation is reduced at the central sharp corners of such pairs of loops, because there are opposing currents in conductors that are almost parallel, leaving the parts of the loops opposite those corners to produce most of the radiation. This separates the major radiating parts of such loops and leads to more gain than can be obtained with other loop shapes.

Before the lemniscate curve is described in detail, it is convenient to define some terms. The generator symbol, 301, perhaps obviously represents the connection to the associated electronic equipment. Hereinafter in this description and the attached claims, the associated electronic equipment will be the type of equipment usually connected to antennas. That equipment would include not only transmitters and receivers for communication, but also such devices as radar equipment and equipment for security purposes. Hereinafter in this description and the attached claims, the distance between the central point and the outer points of the loops will be called the height of the loops. Hereinafter in this description and the attached claims, the maximum dimension perpendicular to the height of the loops will be called the width of the loops.

As FIG. 3 illustrates, the shape is such that the radius (r) from the central point to any point (x) on the curve is the height (h), multiplied by the cosine, raised to a power), of the angle (θ) between the center line of the loops and a line from the central point to that point (x) on the curve, multiplied by a constant (m). Because the cosine has negative values and negative radii do not make much sense, the absolute value is desired. Hereinafter in this description and the attached claims, p will be called the power constant of the curve and m will be called the multiplying constant of the curve.

$$r=h\,|cos(m\theta)|p$$

where $-\pi/2m<\theta<\pi/2\ m$ and $(\pi-/2m)<\theta<\theta<(\pi+\pi/2m)$

It is necessary to limit the angle to values around zero and π radians because it is possible, with some values of multiplying constant, to obtain more than two loops from the above expression. Because the purpose of the expression is to approximately represent the invention, it is legitimate to limit the expression to whatever adequately represents the invention. Also note that because the cosine has its maximum values for mθ equaling zero and π radians, these are the values that will produce the outer points of the curve.

The multiplying constant controls the angle at which the loops approach the center and, thereby, influences the width of the loops. For example, if the multiplying constant were 2, the cosine would be zero when the angle equaled π/4 radians because mπ would be π/2 radians. Of course, the width influences the resonant frequency because it influences the size of the loops. More obviously, the height also influences the resonant frequency. A less obvious fact is that both the multiplying constant and the height influence the shape of the radiation pattern. Therefore, the task of producing the desired radiation pattern with resonance involves the adjustment of both the multiplying constant and the height. For that task, an antenna analysis computer program is most desirable.

The power constant also influences the overall shape of the loops. For example, a mathematician would realize that if the power constant equaled one and the multiplying constant equaled one, the loops would be circles. Because such loops would not approach the central point with the two sides of the loop approximately parallel to each other, thereby not reducing the radiation from the central point, such a combination of power constant and multiplying constant would not be an improvement on the prior art. On the other hand, if the power constant were much less than one, the loops would have long, almost straight portions near the center. In the extreme case, for a power constant equaling zero, the loops would be sectors of a circle.

Although lemniscate curves can produce more gain for a particular bandwidth than triangles, or more bandwidth for a particular gain, perhaps that is not their main advantage. With triangles, there is only one set of dimensions that yield the FIG. 1B type of radiation curve that reduces the minor lobes of radiation very well. That is because there is only one shape, a triangle, that is available. The lemniscate curves, on the other hand, are a set of curves. Therefore, for each type of curve there are dimensions that can produce the FIG. 1B type of radiation curve. That is, it is possible to choose the combination of gain and bandwidth while still choosing the kind of radiation curve. With triangles, once the choice of gain and bandwidth is made, the type of radiation curve is determined.

Figure 1B:
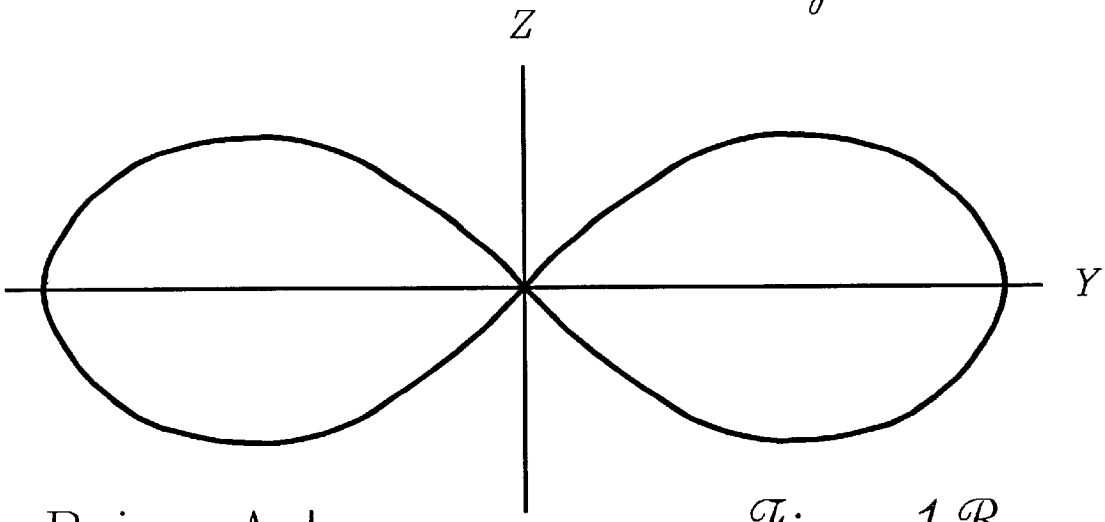
Prior Art Fig. 1B
Figure 1C:
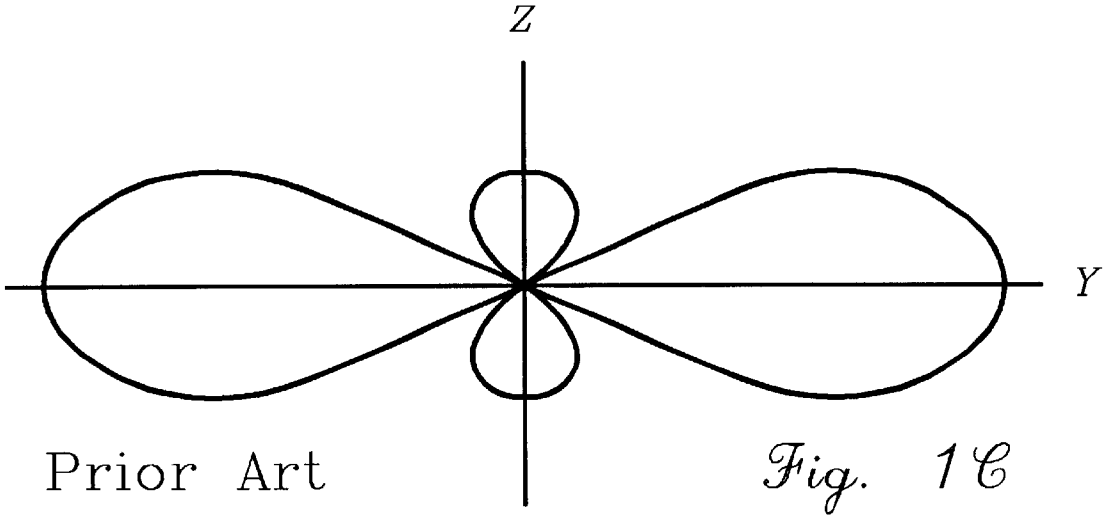
Prior Art Fig. 1C

For example, with dimensions chosen to produce the FIG. 1B type of curve, values of the power constant that are close to zero produce curves that are relatively low in gain and high in bandwidth. Values of the power constant that are larger but still less than unity produce more gain with less bandwidth. Values of the power constant above about 0.4 or 0.5, produce modest increases in gain with substantial decreases in bandwidth. This is because the values of multiplying constants needed to produce the FIG. 1B type of curve, with such power constants, are so close to one that the curves approach the central point almost from the side. This defeats the purpose of using triangles or lemniscates which is to reduce the radiation from the center of the element. In conclusion, the lemniscate gives the designer more flexibility to produce the desired antenna element than does the triangle.

Prior Art—Four Loops

Figure 4:
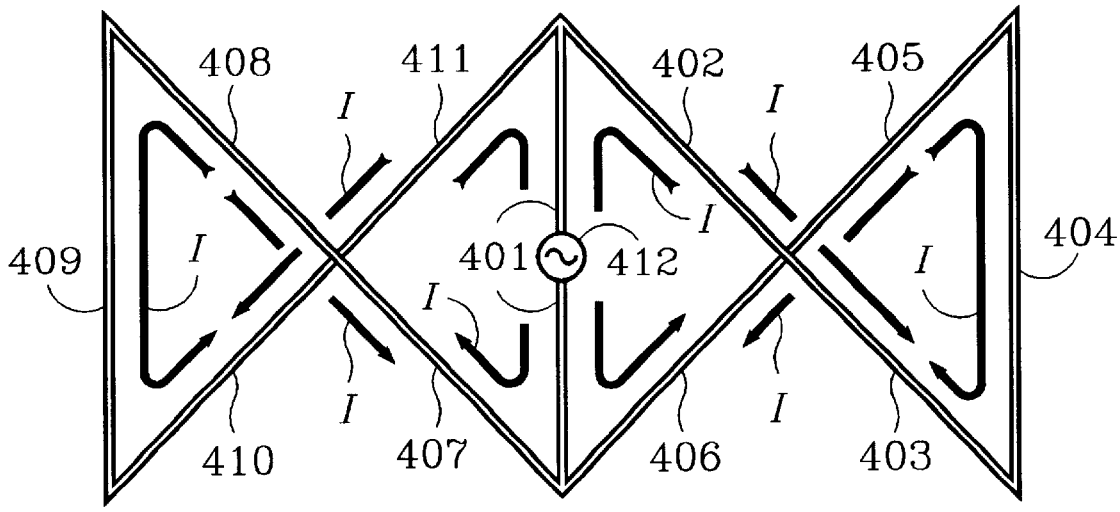
Fig. 4 Prior Art
FIG. 4 illustrates the front view of a quadruple-delta antenna element.

FIG. 4, with parts 401 to 412, illustrates the quadruple-delta antenna element of U.S. Pat. No. 5,966,100. Note that all of the sides of the triangles have been given numbers, so that they can be designated individually. That is, parts 407 and 408 may be one piece of conductor, but they have been given two numbers because they are parts of two different triangles. Also, part 401 has one number because it is one side of the triangles, even though it is broken by the generator symbol, 412. Also note that the crossing diagonal conductors do not touch each other. That is, one current path is from part 401, through parts 402 to 406, and back to part 401. This numbering plan has been applied to the other drawings of antennas with straight sides, except for FIG. 15. In that drawing, the broken central sides were given two numbers because there was a need to refer to the halves of those sides individually.

The antenna element of FIG. 4 appears to be two double-delta antenna elements joined by a common side, 401. Note that it has been chosen that the outside parts, 404 and 409, would be parallel to the central part, 401. That is, the alternative possibility of having the diagonal parts at the center and at the ends was not chosen. In FIG. 4, there are three major radiating parts, 409, 401 and 404, separated by the height of two loops. If the loops had been put together with sharp corners at the ends and at the center, there would be only two major radiating parts and sharp corners reducing radiation at the ends and at the center.

Before proceeding further, there are two more terms that should be defined. Hereinafter in this description and the attached claims, the loops closest to the center of the element will be called the inner conducting loops. Hereinafter in this description and the attached claims, the loops farthest from the center of the element will be called the outer conducting loops.

Figure 5:
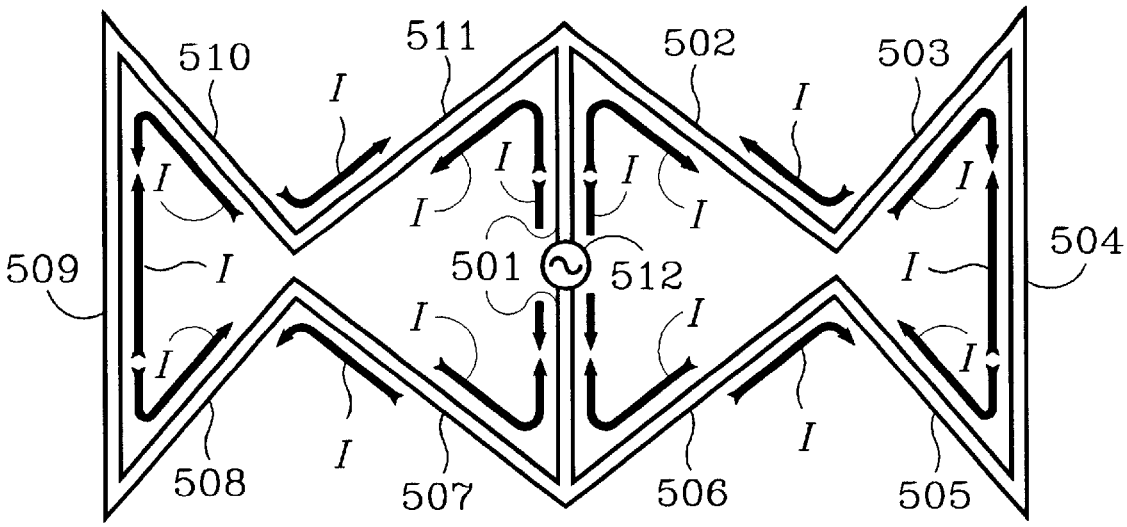
Fig. 5 Prior Art
FIG. 5 illustrates the front view of an expanded quadruple-delta antenna element.

FIG. 5, with parts 501 to 512, shows another embodiment of the quadruple-delta antenna element that was disclosed in the applicant's U.S. Pat. No. 5,805,114. Instead of the approximately one-wavelength loops of the quadruple-delta antenna element, this embodiment has loops with perimeters that are much larger. Typically, the inner loops have perimeters of approximately two wavelengths and the outer loops have perimeters of approximately one and three-quarters wavelengths. This produces a wider structure as well as a higher structure and produces a significantly larger gain. Hereinafter in this description and the attached claims, this embodiment will be called an expanded quadruple-delta antenna element.

Another difference between the two embodiments is that the conductors of the expanded quadruple-delta antenna element do not cross where they approach each other. It also should be noted that the currents in the three parallel conductors are, apparently, not flowing in the same direction at the same time. Although one realizes that the phase of these currents are not all zero degrees or 180 degrees at the same time, it is nevertheless an unexpected situation. One must keep in mind that the aim of an antenna is not just to add radiation in some desired direction but it is also to cancel radiation in undesired directions. With a complicated antenna element, it is most difficult to predict how the device will operate. It must be tested.

Although the perimeters of the loops of the quadruple-delta antenna element may not be equal and exactly one wavelength, the overall lengths of the current paths are approximately two wavelengths. That is, it is a resonant structure. However, the expanded quadruple-delta antenna element has current paths of approximately three and three-quarters wavelengths. It is not at all a resonant structure. This may appear strange when it is realized that resonant structures are most capable of receiving radiation. However, it should be remembered that a resonant antenna system should be presented to the received radiation, not just a resonant antenna. An antenna tuned to resonance will receive well. On the other hand, a resonant antenna that was detuned would not receive very well. Although this expanded quadruple-delta antenna element may appear strange, it works significantly better than the quadruple-delta antenna element for most applications.

THE INVENTION

The Invention—Introduction

Figure 6:
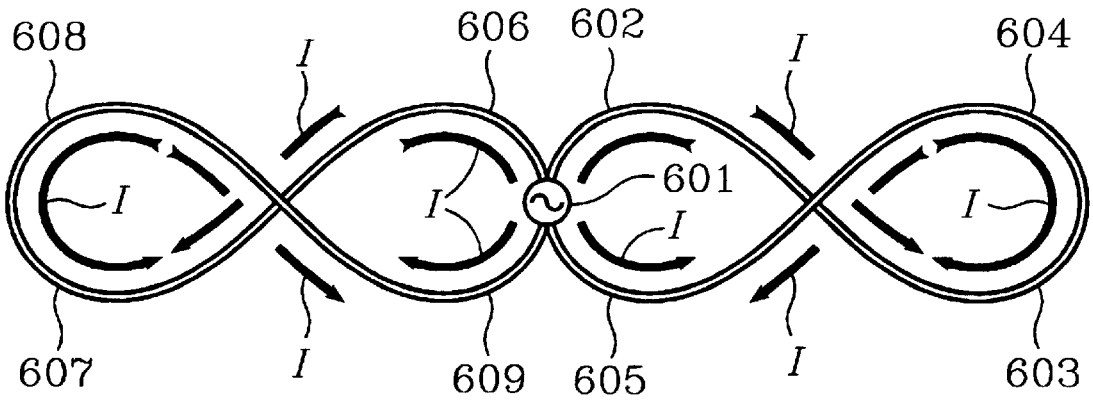
FIG. 6 illustrates the front view of the basic double-lemniscate antenna element and best illustrates the essence of the invention.

FIG. 6 with parts 601 to 609, shows the equivalent arrangement of the quadruple-delta antenna element using lemniscate loops to produce the basic antenna element of this invention. Hereinafter it will be called a basic double-lemniscate antenna element. In this drawing and the other drawings showing curved conductors, it is convenient to label the sides of the curves. Mainly this is just to show which sides of which loops are connected to each other. As with the quadruple-delta antenna element of FIG. 4, there is no connection where the conductors cross. That is, there is a single current path from the generator symbol, 601, through parts 602 to 605, and back to the generator. Although there is no significance to which conductor is in the front or to the rear at these crossing points, it is perhaps wise to adopt one particular choice for an array of elements so that the distances between the corresponding parts of the elements in the array will be equal.

Figure 7:
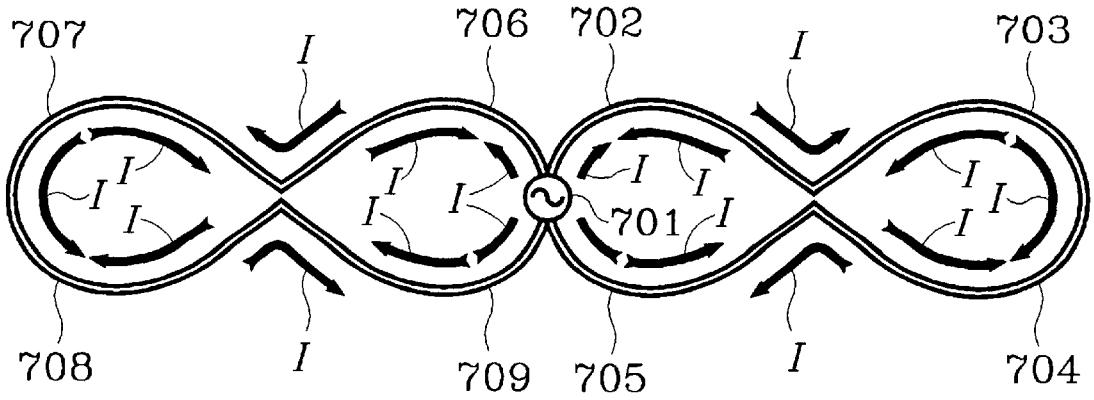
FIG. 7 illustrates the front view of an expanded double-lemniscate antenna element.

FIG. 7, with parts 701 to 709, shows the embodiment of the invention that is an improvement on the expanded quadruple-delta antenna element. Hereinafter in this description and the attached claims it will be called an expanded double-lemniscate antenna element. Note that, in FIGS. 4 to 7, although the expanded elements have been drawn similar in size to the other elements to properly display their characteristics, they are, for a particular wavelength, much larger.

The Invention—Some Variations

As was stated above, the lemniscate curve is a convenience for mathematical analysis, not a definite requirement. That is, it is consistent with this invention to produce loops approximately equal to lemniscates using straight conductors. For example, the outer conducting loops in FIG. 8, with parts 801A, 801B, and 802 to 815, can be considered to be triangles that have outer sides, 805 and 806 or 811 and 812, that have been bowed outward. They could perform similarly to lemniscates with power constants of zero, if they were like sectors of a circle with the arc simulated by two straight conductors. That is, it should be expected that they would be low-in, wide-bandwidth parts of the antenna.

Figure 8:
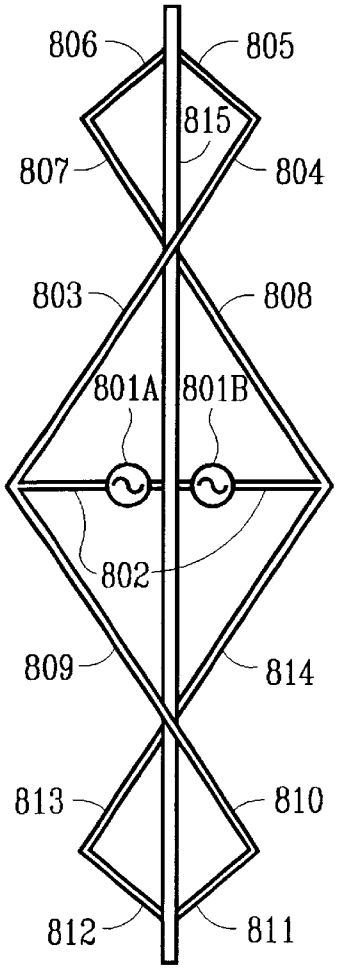
FIG. 8 illustrates the front view of a related four-loop combination of lemniscate loops and triangular loops, and illustrates some possible variations of the basic invention.

FIG. 8 also illustrates the option to combining lemniscate outer conducting loops with triangular inner conducting loops. Because the antenna elements of FIGS. 6 and 7 have two loops at the center, it would require two T matching systems to feed the two loops. Therefore, it is tempting to replace the inner conducting loops with triangular loops that would require only one T matching system to feed both loops. With basic double-lemniscate antenna elements, this may work in some arrays that produce desirable impedances at the feeding points, but it may not. It may be that the length of the central conductor, 802, may be so short that resonance cannot be achieved with a T match of that length. In that case, it may be necessary to employ the system of FIG. 9, with parts 901 to 915. Here the two T parts, 906 and 907, are extended by parts 908 to 911, to the shorting bars, 912 to 915. Another possibility is to use capacitors between the feeding points (F) and the center of part 901 in addition to capacitors in series with the T parts, as is done with some gamma matching systems. One disadvantage of this system is that it complicates the tuning process. These ideas work, but their complexity sheds doubt on the merits of using a triangle instead of a lemniscate just to avoid a double T match. However, with an array like the log-periodic array of FIG. 15 that does not use a matching system for each driven element, there may be an absolute advantage to this choice of loop shapes.

This problem of inadequate element width usually does not arise with the expanded double-lemniscate antenna element of FIG. 7. Because the element usually is not resonant, there usually is much less distance than a quarter wavelength between the center of the element and the first current null on either side. That situation allows T parts that are much shorter than those required by the basic double-lemniscate antenna element. Therefore, it is unlikely that the T extensions or extra capacitors would be needed by expanded double-lemniscate antenna elements.

Figure 9:
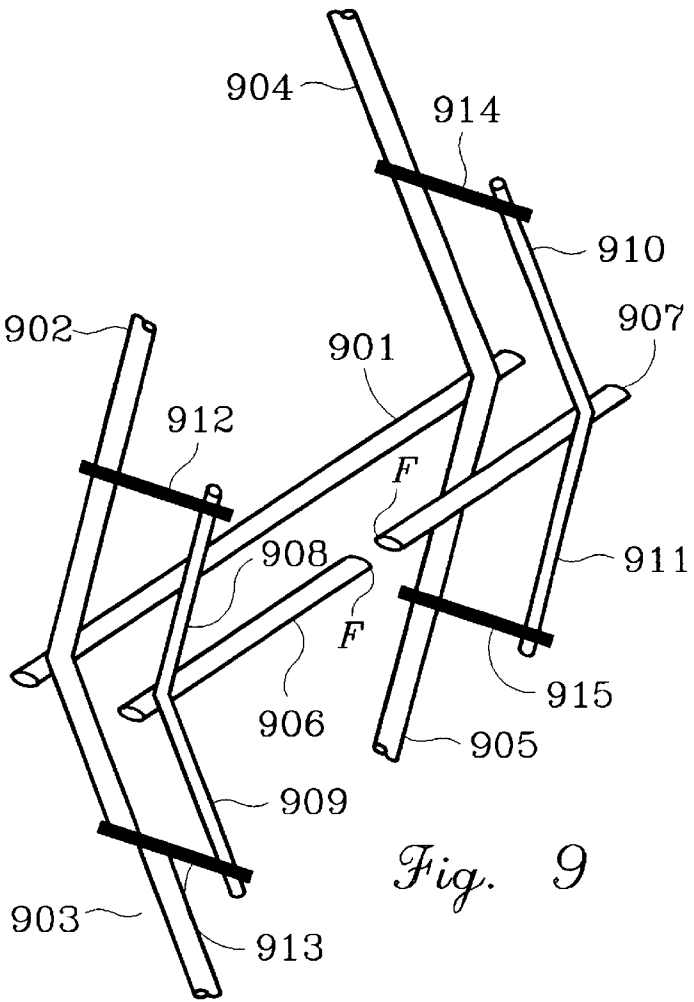
FIG. 9 illustrates a perspective view of a matching system appropriate for the antenna of FIG. 8.

FIG. 9 also illustrates some choices in construction materials. If the antenna element were large, the parts near the central point of support, such as parts 901 to 907 would have large cross-sectional areas because they must support themselves and the parts further from the point of support. Parts 908 to 915 would have smaller cross-sectional areas because they would not be required to support very much. In addition, it would be expected that the larger parts would be tubing to reduce the weight and cost, and the smaller parts, like 912 to 915, would be solid rods, because rods are less expensive than tubes in small sizes.

There are many conventional and acceptable means of connecting the various parts of double-lemniscate antenna elements. For example, they could be bolted, held by various kinds of clamps, or soldered, brazed or welded with or without pipe fittings at the joints. As long as the effect of the means of connection upon the effective length of the parts were taken into account, there seems to be no conventional means of connecting antenna parts that would not be acceptable for double-lemniscate antenna elements.

However, before the final dimensions have been obtained, it is convenient to have the means to make adjustments to the length of the conductors. Often a computer-aided design will produce reasonably correct loop heights and reasonably correct distances between the various double-lemniscate antenna elements in an array. Therefore, adjusting only the widths of the loops on the antenna range may be an acceptable tactic to produce a final design. The shape that is a sector of a circle is convenient for this tactic, because it has circular parts. If the clamps connecting these circular parts to the rest of the loops allowed changes in the lengths of these circular parts, the widths of the loops could be changed without changing the alignment of the high-current parts of the array. Angular loops, such as the ones in FIG. 8, also are convenient for making final adjustments.

Because the conductors of these loops are typically curved, it would be mechanically convenient to use rectangular conductors. However, it must be remembered that radio frequency currents flow in the parts of conductors that are farthest from the center. That is, the currents would flow, essentially, in the outer edges of the conductors. For rectangular conductors, the currents would flow, essentially, in the corners of the conductors. If the conductors were very thin, like sheet metal conductors, the area through which the currents would flow would be small and the resistance would be relatively high. For a dipole, this could be a significant problem, because the radiation resistance of dipole arrays can be rather low. That is, too much power may be dissipated in the conductors relative to the power that is radiated. Fortunately, the radiation resistances of loops usually are larger than the radiation resistances of dipoles, so this efficiency problem is less severe for most double-lemniscate antenna elements. Nevertheless, rectangular conductors produce a mechanical convenience with a possible electrical disadvantage.

Another point illustrated by FIG. 8 is that the loops may have different sizes in the same antenna element. This might be suspected because the inner conducting loops would receive much more radiation from the other loops than would the outer conducting loops, because the inner conducting loops are closer to the other loops. That is, the mutual impedances of the inner and outer conducting loops would be different from each other. Therefore, as FIG. 8 illustrates, it is typical that the outer conducting loops should be smaller than the inner conducting loops. For example, one design of a basic double-lemniscate antenna element for 146 megahertz, with conductor diameters of 0.25 inches, a power factor of 0.2, and a multiplying factor of 2.43, had inner conducting loop heights of 34 inches and outer conducting loop heights of 29.5 inches.

It also is possible to have different power factors and multiplying factors for the two sets of loops. However, because the multiplying factor controls the angle at which the loops approach the crossing point, it probably would be convenient to use the same multiplying factor for the loops so that there would not be a bend in the conductors at the crossing points. Note also that even if the loops were equal in size, there might be current maxima near the crossing points but not necessarily right at the crossing points.

Because there always is a bend in the conductors where they come together in the expanded double-lemniscate antenna element, there is no advantage to having the same multiplying factor for the loops. For example, one design of an expanded double-lemniscate antenna element for 146 megahertz, with conductor diameters of 0.25 inches and a power factor of 0.5, had inner conducting loop heights of 51.5 inches with multiplying factors of 1.4, and outer conducting loop heights of 44.5 inches with multiplying factors of 1.17.

Beside the option of having loops of differing shapes and sizes in the same element, four-loop elements differ from two-loop elements in yet another respect. The null of FIG. 1B is not the ideal of four-loop elements because a better radiation curve is available with three tiny minor loops where the null is located in FIG. 1B. That is, a superior reduction of the radiation in the general direction of the null in FIG. 1B would be available if the design produced three tiny minor lobes than if the design produced a just one null in one particular direction. The dimensions quoted above for the basic double-lemniscate antenna element produced an element with three tiny minor lobes.

The expanded quadruple-delta antenna element typically produces larger minor lobes than those produced by the quadruple-delta antenna element, but they are still small. The expanded double-lemniscate antenna element may produce only one wider, but still small, minor lobe where these other elements produce three lobes. The larger but still small minor lobes could be considered the price paid for the higher gain of the expanded versions of these elements. An additional price of the expanded quadruple-delta antenna element is a narrower bandwidth than the quadruple-delta antenna element. The expanded double-lemniscate antenna element produces not only more gain than the expanded quadruple-delta antenna element but it also can produce a much wider bandwidth with that increased gain. This is partly caused by the greater flexibility in designs available with four lemniscate shaped loops. That is, not only can the designer choose a variety of parameters, but the inner conducting loops can have different parameters from those of the outer conducting loops.

The Invention—Strengthening Conductors

Another modification to the basic double-lemniscate invention that is illustrated by FIG. 8 is the use of the central strengthening conductor, 815. As was disclosed by the applicant's U.S. Pat. No. 5,995,060 entitled Strengthened Double-Delta Antenna Structure, it is convenient to have conducting supports for large antenna elements in addition to the support of the element conductors themselves. This is particularly convenient with turnstile arrays, as in FIG. 11, where the added strengthening conductor can be the mast. It also is particularly convenient with log-periodic arrays, as in FIG. 15, so that the whole antenna can grounded for direct currents to give some measure of lightning protection. Hereinafter, double-lemniscate antenna elements having these additional strengthening conductors will be called strengthened double-lemniscate antenna elements.

Convenient though it is from a mechanical point of view, it must be suspected that a conductor placed across the loop would change the nature of the antenna element. As was explained in the previous patent, this is not true in this particular case for the following reasons. In FIG. 8, there are two generators, 801A and 801B, to imply that there is a balanced feeding system. If the center of the antenna element were at ground potential and the antenna element were connected to the associated electronic equipment in a balanced manner, which is desirable anyway, the voltages at points on parts 803, 804 and 805 would be equal to and of opposite polarities to the voltages at corresponding points on parts 808, 807 and 806. These voltages would be equal because the loops are symmetrical and the corresponding points would be at equal distances via the conductors from the central, grounded point. They would be of opposite polarities because no currents would flow around the loops if these voltages were of the same polarities. At the outer end of the loops, where parts 805 and 806 are connected, the voltage must be of equal magnitude and of opposite polarity to itself. The only voltage that satisfies those criteria is zero volts. That is, that point would be at ground potential. Therefore, if a conductor, such as part 815, were connected between the central point and the junction of parts 805 and 806, no current would flow in part 815 due to that connection, because the two ends of that additional conductor would be at ground potential.

The other way that a current could be in part 815 is by radiation. Referring to FIG. 7, it can be observed that the currents on the loop on the two sides of part 815 would be flowing in opposite directions. That is, whatever voltages would be induced into part 815 by the currents in parts 803, 804 and 805 would be cancelled by the voltages induced by the currents in parts 808, 807 and 806. Therefore, no currents would flow in part 815 either by the connection to the loops or by voltages induced by the currents in the loops. That is, the addition of part 815 would not change the operation of the loops if the loops were perfectly balanced. Fortunately, it would be difficult to detect the change if the balance were good but not perfect. That would not be true if part 815 were connected between two other points on the loop.

The Invention—Double Loops

For some applications, a variation of this basic double-lemniscate antenna element can be beneficial. When antenna parts are close to each other or when antennas are close to the ground, in terms of wavelengths, the terminal impedances can be rather low. This might produce a problem of efficiency if the loss resistance of the parts became significant relative to the resistance that represented the antenna's radiation. To raise the impedance of dipoles, one might use folded dipoles. The equivalent tactic with loops is to use multiturn loops, as in U.S. Pat. No. 5,966,100.

Figure 10:
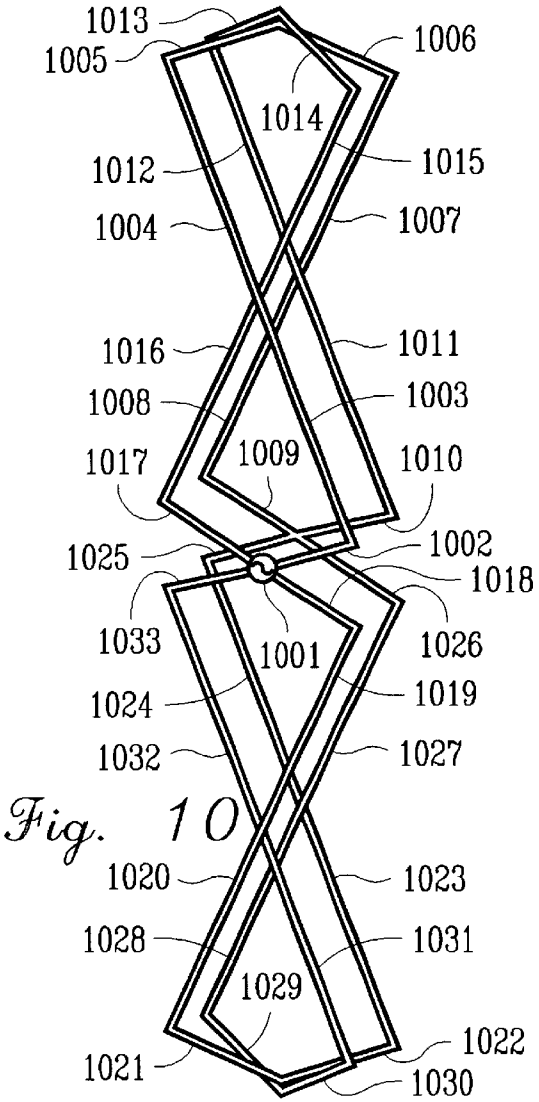
FIG. 10 illustrates a perspective view of a double-loop version of the basic double-lemniscate antenna element.

FIG. 10 shows the equivalent embodiment of basic double-lemniscate antenna elements. Hereinafter, this element will be called a double-loop basic double-lemniscate antenna element. The tactic is to replace the single current paths around the loops with paths that allow the currents to travel around the loops twice. In FIG. 10, one current path is from the generator, 1001, through parts 1002 to 1009, to the second central point, and then through parts 1010 to 1017 to return to the generator. The other current path is from the generator, through parts 1018 to 1033, and back to the generator. If the connection to the associated electronic equipment were made in a balanced manner, the second central point, where parts 1009, 1010, 1025, and 1026 meet, also would be at ground potential, because the distances between this point and the generator by the four paths would be equal. Therefore, this second central point could be connected to the grounded boom, for example. However, there is no particular reason to expect that the outer points of this structure would be at ground potential, and those points probably could not be directly connected to a strengthening part similar to part 815. However, they could be connected to a strengthening conductor through short insulators, because the loop currents surrounding the strengthening conductor would be equal in magnitude and opposite in phase. That is, there would be no net voltages induced into the strengthening conductor by radiation.

Depending on the dimensions, this double-loop tactic can significantly raise the terminal impedance. As it is with dipoles, this tactic also can produce wider bandwidths. It is instructive to consider the two elements to be similar to two coupled resonant circuits, like a tuned transformer. That is, the mutual impedance from the secondary resonant circuit can produce three resonances in the primary resonant circuit, and thereby widen the bandwidth. Of course, as it is with dipoles, more than two current paths around the loops could be used.

When the two basic double-lemniscate antenna elements are close to each other, there is a slight difference in the radiation in the two directions perpendicular to the planes of the conductors. If the spacing were larger, the difference would be larger. Usually, this difference would be minimized by a close spacing, but sometimes the difference may be useful. If only one double-loop basic double-lemniscate antenna element could be used, perhaps because it were large, using a wider spacing might be a convenient tactic to get a somewhat unidirectional radiation pattern.

These double-loop elements probably would not be appropriate for expanded double-lemniscate antenna elements because these expanded elements usually are not resonant. Particularly, if the length of the conductors around the loops were not an integral number of wavelengths, the currents in the conductors that are close and parallel to each other would not be in phase. However, it may be possible to design useful expanded double-lemniscate antenna elements with total current path lengths around the loops of 3 wavelengths or 4 wavelengths. They may be adequate for some purposes but, perhaps, not the best that can be achieved.

APPLICATIONS

Applications—Turnstile Arrays

Figure 11:
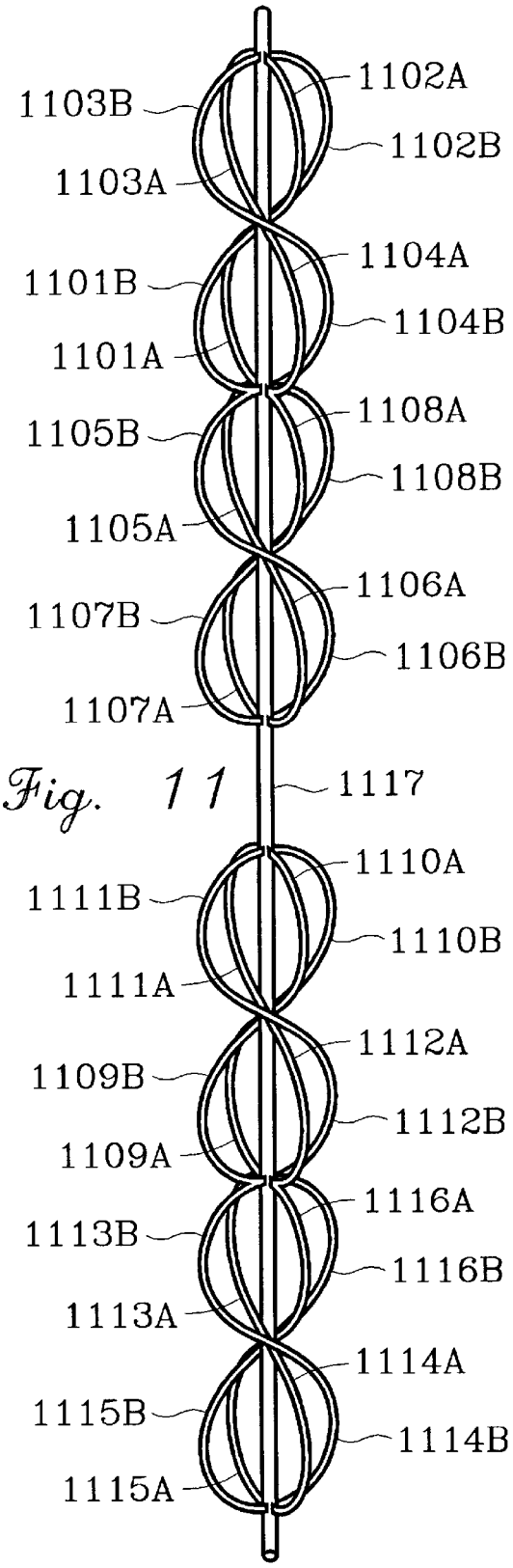
FIG. 11 illustrates a perspective view of two turnstile arrays of basic double-lemniscate antenna elements.

These double-lemniscate antenna elements may be used in the ways that other antenna elements are used. That is, they may be combined with other double-lemniscate antenna elements to produce larger arrays. For example, for broadcasting or for networks of stations, a horizontally-polarized radiation pattern is often needed that is omnidirectional instead of unidirectional in the horizontal plane. To achieve this, an old antenna called a turnstile array sometimes has been used. It has two half-wave dipole antennas oriented at right angles to each other and fed 90 degrees out of phase with each other. FIG. 11 shows the equivalent arrangement of double-lemniscate antenna elements that would serve the same purpose. Hereinafter, this arrangement will be called a turnstile array of double-lemniscate antenna elements.

In FIG. 11, there are two such arrays. Parts 1101A to 1108A form one double-lemniscate antenna element for the top array and parts 1101B to 1108B form the other double-lemniscate antenna element for the top array. In the bottom array, parts 1109A to 1116A form one element and parts 1109B to 1116B form the other element. Conventional matching and phasing systems for turnstile arrays could be used, so they are not shown in FIG. 11 to avoid unnecessary confusion in the diagram.

Such an array would produce more gain in the H radiation pattern, which usually would be the vertical radiation pattern, than a similar array of dipoles or lemniscate antenna elements. That is, if it were necessary to have several turnstile arrays stacked vertically for increased gain, the stack of turnstile arrays of double-lemniscate antenna elements would require fewer feed points for an equal amount of gain.

As was explained above, if a double-lemniscate antenna element were connected to the associated electronic equipment in a balanced manner, the outer points of the loops would be at ground potential. Therefore, as shown in FIG. 11, turnstile arrays of double-lemniscate antenna elements can be connected to a conducting mast (1117) at the center and at the outer points of the loops to produce a rugged antenna. Note that the crossing points of the elements would not be connected to the mast because there is no reason to believe that they are at ground potential. The expanded double-lemniscate antenna element, with conductors that do not cross, has an advantage in this array because there is no need to bend the conductors to avoid contact with the mast.

Of course, turnstile arrays could be made with three or more double-lemniscate antenna elements, spaced physically and electrically by less than 90 degrees. For example, three elements could be spaced by 60 degrees. Such arrays may produce a radiation pattern that is closer to being perfectly omnidirectional, but such an attempt at perfection would seldom be necessary with basic double-lemniscate antenna elements. More useful might be two elements spaced physically and electrically by angles that may or may not be 90 degrees, with equal or unequal energy applied. Such an array could produce a somewhat directive pattern, which might be useful if coverage were needed more in some directions than in other directions. Because the expanded double-lemniscate antenna elements are wider they produce a narrower radiation pattern in the principal E plane than do the basic double-lemniscate antenna elements. This narrower pattern probably will produce a pattern in a two-element array that is not as omnidirectional than is desired. That is, there probably would be more reason to use three elements spaced by 60 degrees if expanded double-lemniscate antenna elements were used in a turnstile array.

Applications—Collinear and Broadside Arrays

Another application of double-lemniscate antenna elements arises from observing that half-wave dipoles traditionally have been positioned in the same plane either end-to-end (collinear array), side-by-side (broadside array), or in a combination of those two arrangements. Often, a second set of such dipoles, called reflectors or directors, is put into a plane parallel to the first plane, with the dimensions chosen to produce a somewhat unidirectional pattern of radiation. Sometimes an antenna element is placed in front of a reflecting screen (1210), as in FIG. 12. Such arrays have been used on the high-frequency bands by short-wave broadcast stations, on very-high-frequency bands for television broadcast reception, and by radio amateurs.

Hereinafter in this description and the attached claims, the front end of an antenna will be the end pointing in the direction of the desired radiation. The rear end of an antenna will be the end opposite from the front end.

Figure 12:
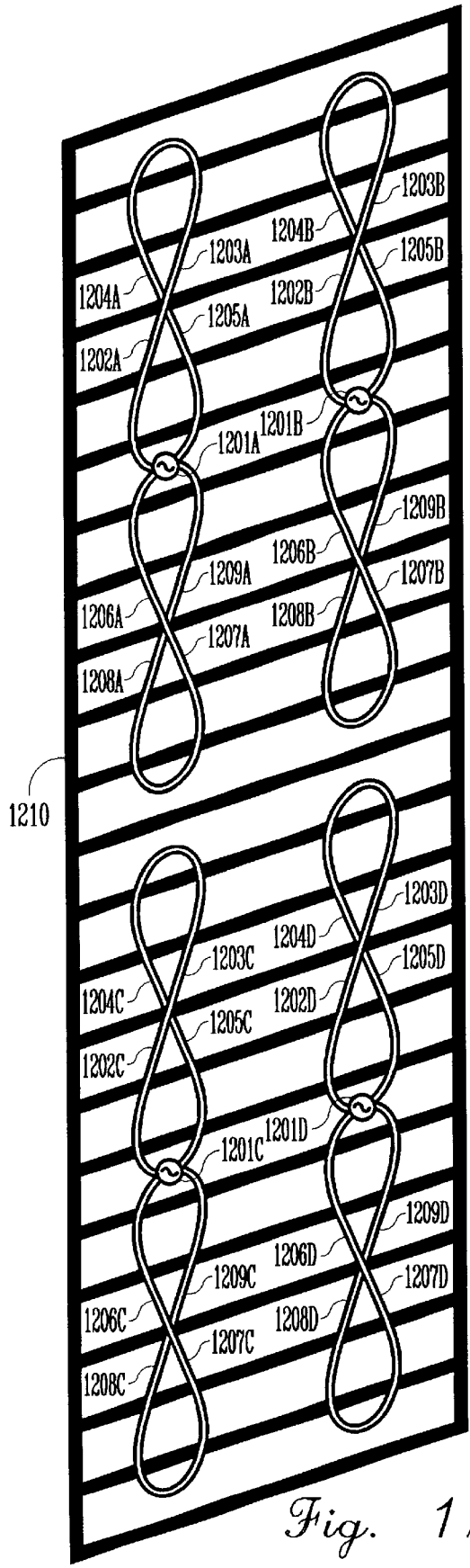
FIG. 12 illustrates a perspective view of collinear and broadside arrays of basic double-lemniscate antenna elements in front of a reflecting screen.

The same tactics can be used with double-lemniscate antenna elements, as FIG. 12 shows. However, the traditional definitions of what constitutes a collinear array or a broadside array of dipoles does not serve the purpose with the curved conductors of double-lemniscate antenna elements. For example, what would be an end-to-end alignment if there were no ends? Instead, it is a more universal definition to specify the alignments in terms of the E and H fields. In those terms, a collinear array would have the elements aligned in the direction of the E field. Likewise, the broadside array could be defined as having the elements aligned in the direction of the H field.

By these definitions, it is apparent that the element having parts 1201A to 1209A is in a collinear arrangement with the element having parts 1201B to 1209B, because they are aligned in the direction of their E fields. The element having parts 1201C to 1209C and the element having parts 1201D to 1209D are similarly aligned. The A element is in a broadside arrangement with the C element, because they are aligned in the direction of their H fields. The B element and the D element are similarly aligned.

Perhaps the main advantage of using double-lemniscate antenna elements rather than dipoles in such arrays is the less complicated system of feeding the array for a particular overall array size. That is, each double-lemniscate antenna element would perform in such an array as well as several half-wave dipoles.

Sometimes collinear or broadside arrays of dipoles have used unequal distributions of energy between the dipoles to reduce the radiation in undesired directions. Since double-lemniscate antenna elements reduce such undesired radiation anyway, there would be less need to use unequal energy distributions in equivalent arrays to achieve the same kind of result. Nevertheless, if such an unequal energy distribution were used, it should be less complicated to implement because of the less complicated feeding system.

Applications—Nonlinear Polarization

Yet another application of double-lemniscate antenna elements concerns nonlinear polarization. For communications with satellites or for communications on earth through the ionosphere, the polarization of the signal may be elliptical. In such cases, it may be advantageous to have both vertically polarized and horizontally polarized antennas. They may be connected to the associated electronic equipment together to produce a circularly polarized antenna, or they may be connected separately for a polarity diversity system. Also, they may be positioned at approximately the same place or they may be separated to produce both polarity diversity and space diversity.

Figure 13:
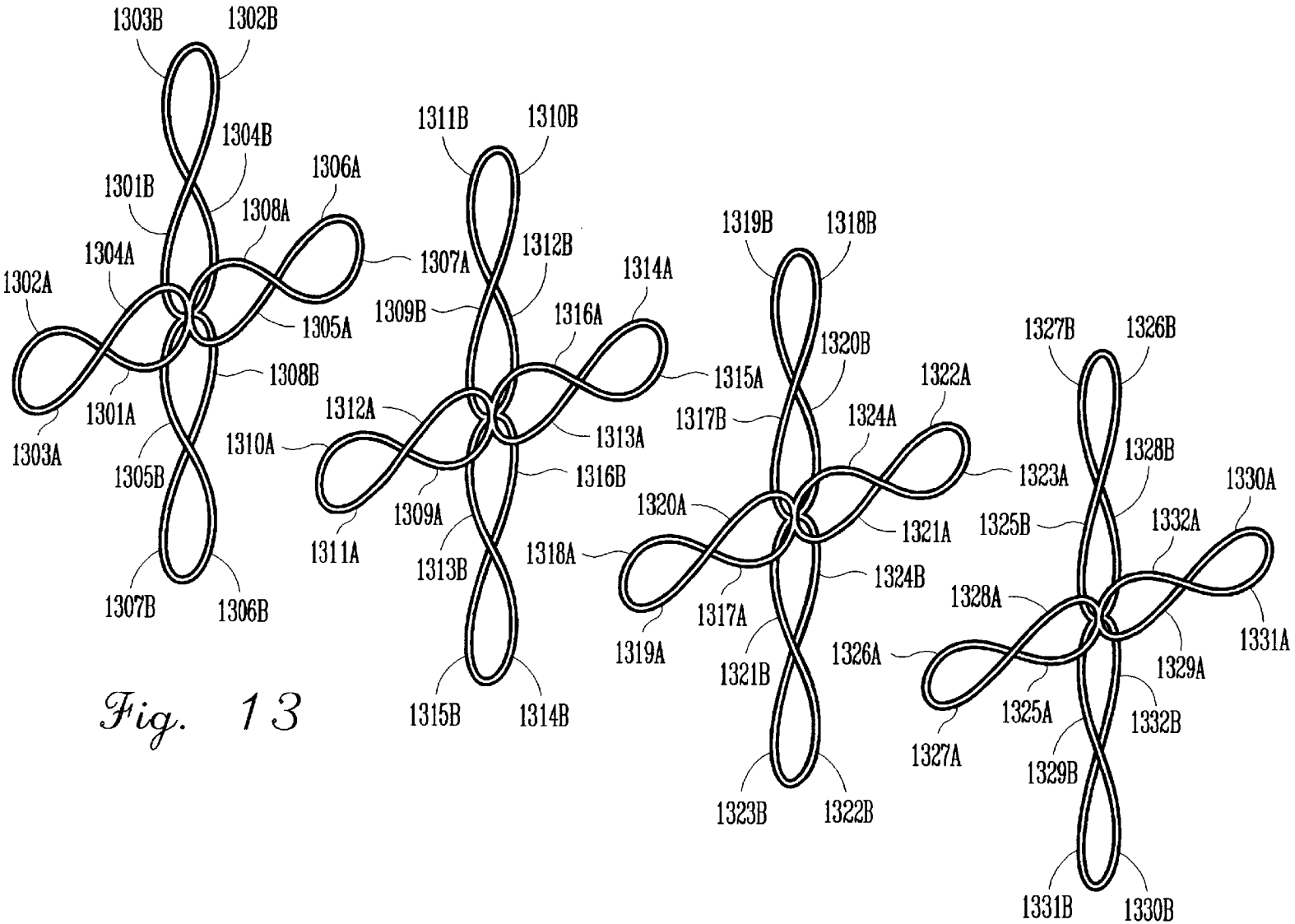
FIG. 13 illustrates a perspective view of an array of basic double-lemniscate antenna elements for producing elliptically polarized radiation.

FIG. 13 illustrates an array of double-lemniscate antenna elements for achieving this kind of performance. Parts

1301A to 1332A form a vertically polarized array and parts 1301B to 1332B form a horizontally polarized array. The boom and feeding system are not shown because they would be conventional and would unnecessarily complicate the drawing. If the corresponding elements of the two arrays were approximately at the same positions along the supporting boom, as in FIG. 13, the phase relationship between equivalent parts in the two arrays usually would be about 90 degrees for approximately circular polarization. If the corresponding elements of the two arrays were not at the same position on the boom, as is common with similar half-wave dipole arrays, some other phase relationship could be used because the difference in position plus the difference in phase could produce the 90 degrees for circular polarization. It is common with equivalent half-wave dipole arrays to choose the positions on the boom such that the two arrays can be fed in phase and still achieve circular polarization.

However, one should not assume that this choice of position on the boom and phasing does not make a difference in the radiation produced. If two half-wave dipoles were positioned at the same place and were phased 90 degrees, there would tend to be a maximum of one polarity toward the front and a maximum of the other polarity toward the rear. For example, there might be a maximum of right-hand circularly polarized radiation to the front and a maximum of left-hand circularly polarized radiation to the rear. In the same example, there would be a null, ideally, of left-hand radiation to the front and a null of right-hand radiation to the rear. An equivalent array that produces the phase difference entirely by having the two dipoles in different positions on the boom would perform differently. Depending on how it was connected, it could have maxima of left-hand radiation to the front and rear. In such a case, the right-hand radiation would have maxima to the side and minima to the front and rear.

Of course, such two-element arrays of individual dipoles would perform differently from corresponding arrays of double-lemniscate antenna elements. Also, if these elements were put into larger arrays, the patterns would change some more. Nevertheless, one should not assume that the choice of using phasing or positions on the boom to achieve circular polarization does not change the antenna performance. One must make the choice considering what kind of performance is desired for the particular application.

Although this arrangement of elements usually is chosen to produce circularly polarized radiation, one also should note that a phase difference of zero degrees or 180 degrees will produce linear polarization. As the array is shown in FIG. 11, those linear polarizations would be at 45-degree angles to the earth, which probably would not be desired. It probably would be more desirable to rotate the array around the direction of the axes of the loops by 45 degrees to produce vertical or horizontal polarization. With such an array, it would be possible to choose vertical polarization, horizontal polarization, or either one of the two circular polarizations by switching the amount of phase difference applied to the system. One could even apply unequal powers to the two halves of the array to produce other linear and elliptical polarizations. Such a system may be very useful to radio amateurs who use vertical polarization for frequency modulation, horizontal polarization for single sideband and Morse code, and circular polarization for satellite communication on very-high-frequency and ultra-high-frequency bands. In addition, because signals bounced off the moon have varying polarizations, it would be convenient to be able to vary the polarization of the antenna. Also, such a system could be useful on the high-frequency bands because received signals can have various polarizations.

Applications—Yagi-Uda Arrays

Yet another application, commonly called an end-fire array, has several double-lemmniscate antenna elements positioned so that they are in parallel planes, the principal H planes are parallel to each other, and the central points of the elements are aligned in the direction perpendicular to those planes. One double-lemniscate antenna element, some of them, or all of them could be connected to the associated electronic equipment. If the second double-lemniscate antenna element from the rear were so connected, as in FIG. 14, and the dimensions produced the best performance toward the front, it could logically be called a Yagi-Uda array of double-lemniscate antenna elements. Hereinafter, that name will be used for such arrays.

Figure 14:
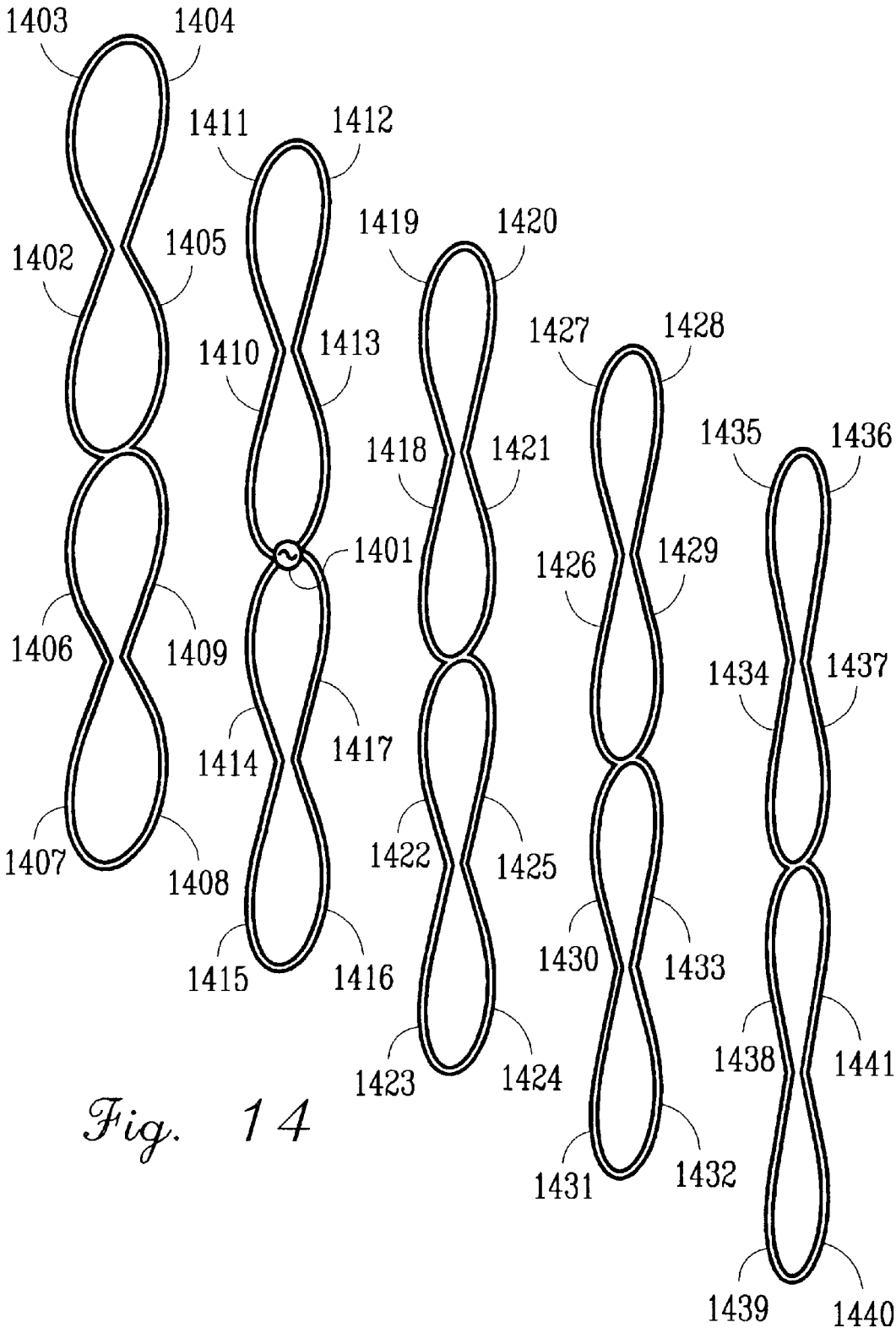
FIG. 14 illustrates a perspective view of a Yagi-Uda array of expanded double-lemniscate antenna elements.

FIG. 14 illustrates such a Yagi-Uda array with parts 1401 to 1441. Hereinafter, the double-lemniscate antenna element that is connected to the associated electronic equipment, as indicated by the generator symbol, 1401, will be called the driven element. The element to the rear, with parts 1402 to 1409 will be called the reflector element. The remaining elements will be called the director elements. This terminology is consistent with the traditional names for dipoles in Yagi-Uda arrays. Another possible, but less popular, array would have just two of such elements with the rear one connected, called the driven element, and the front one not connected, called the director element.

The basic double-lemniscate antenna element works well in a Yagi-Uda array, but the expanded double-lemniscate antenna element gives more gain. It is also true that because antenna elements become very small and critical at ultra-high frequencies, the larger width of the expanded double-lemniscate antenna elements makes them more convenient for such frequencies. That is the reason why the elements illustrated in FIG. 14 are the expanded kind.

The tactic for designing a Yagi-Uda array is to employ empirical methods rather than equations. This is partly because there are many combinations of dimensions that would be satisfactory for a particular application. Fortunately, there are computer programs available that can refine designs when reasonable trial designs are presented to the programs. That is as true of arrays of double-lemniscate antenna elements as it is for dipole arrays. To provide a trial design, it is common to make the driven element resonant near the operating frequency, the reflector element resonant at a lower frequency, and the director elements resonant at progressively higher frequencies from the rear to the front. Then the computer program can find the best dimensions near to the trial dimensions.

The use of double-lemniscate antenna elements in such an array, instead of dipoles, differs in two respects. Since the radiation pattern in the principal H plane can be changed, that is something to choose. A pattern like that of FIG. 1B may be chosen to reduce the radiation in undesired directions. Also, as stated above, the double-lemniscate antenna element allows greater flexibility compared to the quadruple-delta antenna element, because the FIG. 1B type of pattern can be obtained with a variety of combinations of gain and bandwidth. The second difference is that for arrays that have double-lemniscate antenna elements aligned from the front to the rear, one should remember that the principal radiating parts, the outer ends and the central parts, preferably should be aligned to point in the direction of the desired radiation, perpendicular to the planes of the individual elements. That is somewhat important in order to achieve the maximum gain, but it is more important in order to reduce the radiation in undesired directions. Therefore, when the resonant frequencies of the elements must be unequal, the widths of the loops should be chosen so that the heights of the loops are equal. That is, the heights of the loops preferably should be chosen to get the desired pattern in the principal H plane, and the widths should be chosen to achieve the other goals, such as the desired gain.

As was mentioned before, the kind of lemniscate curve that has a value of power constant equaling zero is particularly convenient for such alignments. Because this curve is a sector of a circle, the whole of the outer parts of the curves would be aligned if the outer points of the curves were aligned, no matter what the multiplying constants were. Therefore, one would expect better performance in reducing the minor lobes of radiation with such curves. Other lemniscate curves would have different curvatures with the same power constant if the values of the multiplying constants were unequal. Perhaps it is apparent that in FIG. 14, although the outer points of the curves are aligned, away from those points, the curves of parts 1403 and 1404 are not aligned with the curves of parts 1435 and 1436.

Applications—All-Driven Arrays

Figure 15:
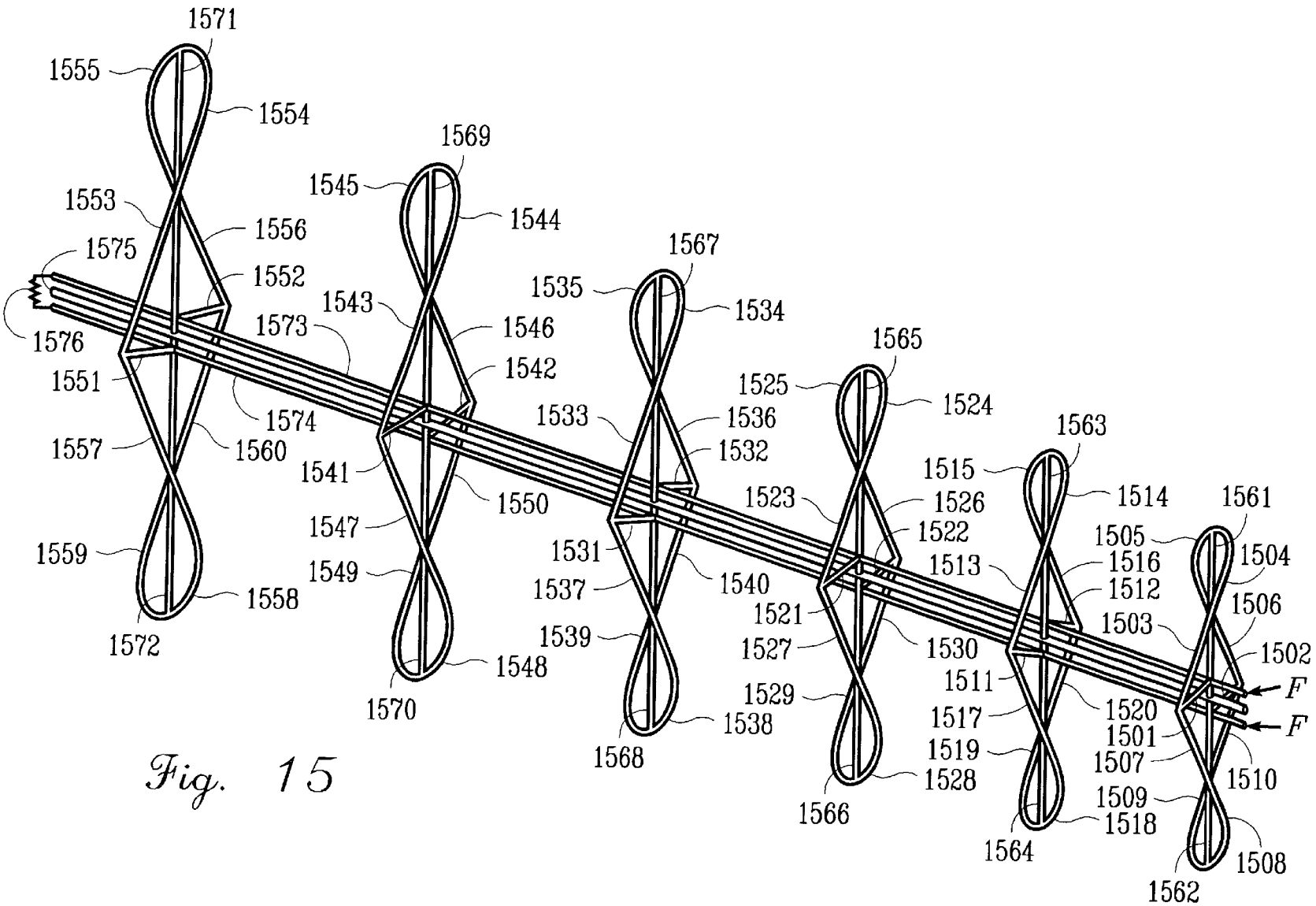
FIG. 15 illustrates a perspective view of a log-periodic array of elements that are combinations of lemniscates and triangles.

There are several possibilities for all-driven end-fire arrays, but the mutual impedances usually make such designs rather challenging and the bandwidths can be small. The log-periodic array, as illustrated by FIG. 15, is a notable exception. A smaller, feasible all-driven array would be just two identical double-lemniscate antenna elements that are fed 180 degrees out of phase with each other. The distance between the elements would not be critical, but one-eighth of a wavelength would be a reasonable value. This would be similar to the dipole array disclosed by John D. Kraus in his article "A Small But Effective 'Flat Top' Beam" in Radio of March 1937, p. 56, which is commonly called a W8JK array, after his amateur-radio call letters. Since the impedances of the two elements are equal when the phase difference is 180 degrees, it is relatively easy to achieve an acceptable bidirectional antenna by applying such tactics. If a balanced transmission line were used, the conductors going to one element would be simply transposed. For coaxial cable, the use of an extra electrical half wavelength of cable going to one element might be better to provide the desired phase reversal. If the space were available, such a bidirectional array of double-lemniscate antenna elements could be very desirable in the lower part of the high-frequency spectrum where rotating such large antennas may not be practicable.

Another possibility is two elements spaced and connected so that the radiation in one direction is almost canceled. An apparent possibility is a distance between the elements of a quarter wavelength and a 90-degree phase difference in their connection. Other distances and phase differences to achieve unidirectional radiation will produce more or less gain, as they will with half-wave dipoles.

Applications—Log-Periodic Arrays

The log-periodic array of double-lemniscate antenna elements is similar to the log-periodic dipole antenna disclosed by Dwight E. Isbell in his U.S. Pat. No. 3,210,767 entitled Frequency Independent Unidirectional Antennas. Hereinafter, that combination will be called a double-lemniscate log-periodic array. Log-periodic arrays of half-wave dipoles are used in wide-band applications for military and amateur-radio purposes, and for the reception of television broadcasting. The merit of such arrays is in a relatively constant impedance at the terminals and a reasonable radiation pattern across the design frequency range. However, their gains are poor compared to narrow band arrays of similar lengths. Although one would expect that gain must be traded for bandwidth in any antenna, it nevertheless is disappointing to learn of the low gain of such relatively large arrays.

If one observed the radiation pattern of a typical log-periodic dipole array in the principal E plane, it would appear to be a reasonable pattern of an antenna of reasonable gain, because the major lobe of radiation would be reasonably narrow. However, the principal H plane would show a considerably wide major lobe that would indicate poor gain. Of course, this poor performance in the principal H plane is caused by the use of half-wave dipoles. Because half-wave dipoles have circular radiation patterns in the principal H plane, they do not help the array to produce a narrow major lobe of radiation in that plane.

The basic double-lemniscate antenna elements are well suited to improve the log-iodic array because they can be designed to reduce the radiation 90 degrees away from the center of the major lobe, as in FIG. 1B. That is, for a horizontally polarized log-periodic array, as in FIG. 15, the radiation upward and downward is reduced. However, since the overall array of parts 1501 to 1576 has basic double-lemniscate antenna elements of various sizes, several of which are used at any particular frequency, it is overly optimistic to expect that the radiation from the array in those directions will be reduced as well as it can be from one basic double-lemniscate antenna element operating at one particular frequency. Nevertheless, the reduction of radiation in those directions and, consequently, the improvement in the gain can be significant.

The expanded double-lemniscate antenna element probably would not be appropriate for a log-periodic array. This is because the relationship between the impedances of the elements is important to the operation of the antenna, and the log-periodic system is designed for series-resonant elements. That is, it is assumed that the below the resonant frequency the impedance will be capacitive and above resonance the impedance will be inductive. Because the expanded double-lemniscate antenna element may be closer to parallel resonance than series resonance, the impedance may vary in the opposite direction. However, it is always possible that a system may be devised to use these elements in a log-periodic type of array. It is, perhaps, more possible to design adequate expanded double-lemniscate antenna elements that are series resonant.

A difficulty with traditional log-periodic arrays is that the conductors that are feeding the various elements in the array also are supporting those elements physically. In FIG. 15, they are parts 1573 and 1574. Hereinafter in this description and the attached claims, those conductors will be called the feeder conductors. Those traditional arrays require, first of all, that the feeders must not be grounded. Therefore, the feeder conductors must be connected to the supporting mast by insulators. Not only is this undesirable because insulators usually are weaker than metals, but it also is undesirable because it would be preferable to have the antenna grounded for direct currents for some lightning protection. Another difficulty is that the characteristic impedance between the feeder conductors should be rather high for proper operation. Because the impedance depends on the ratio of the spacing to the conductor diameters, the large size of the feeder conductors needed for mechanical considerations requires a wide spacing between these conductors to obtain the desired impedance. That, consequently, requires supporting insulators between the feeder conductors that are longer than would be desired.

The common method of constructing log-periodic arrays is to support the antenna elements by insulators connected to the grounded boom instead of using strong feeder conductors. Then the connections between the elements are made with a pair of wires that cross each other between the adjacent elements. Not only is such a system undesirable because the elements are supported by insulators, but also it is undesirable because the feeder conductors do not have a constant characteristic impedance. Nevertheless, many people seem to be satisfied with this compromise.

Because strengthened double-lemniscate antenna elements are supported by metal conductors (1561 to 1572) that are attached with metal clamps to the grounded boom (1575), they offer particular benefits in log-periodic arrays. Since the loops are supported by the strengthening conductors, the loop conductor cross-sectional areas can be relatively small. Likewise, since the feeder conductors are merely connected to the loops, rather than supporting them, the feeder conductors can be small in cross-sectional area. Therefore, there is less need for wide spaces between the boom and the feeder conductors to achieve the required characteristic impedance. This reduces the length of the insulators holding the feeder conductors and reduces the strength required in those insulators. In addition, the whole array can be grounded for direct currents through the boom, mast and tower. Therefore, much of the mechanical problems of log-periodic arrays are solved by the use of strengthening conductors.

As was stated above, arrays that have double-lemniscate antenna elements aligned from the front to the rear, preferably should have their central and outer points aligned to point in the direction of the desired radiation, perpendicular to the planes of the individual elements. That is, the heights of the loops should be equal. That equal-height alignment usually is not a problem with Yagi-Uda arrays. This is partly because only one of the double-lemniscate antenna elements in the array is connected to the associated electronic equipment, and partly because the range of frequencies to be covered usually is small enough that there is not much difference in the sizes of the double-lemniscate antenna elements in the array. Therefore, it is preferable and convenient to have equal loop heights.

One problem with double-lemniscate log-periodic arrays, in this respect, is that the purpose of log-periodic arrays is to cover a relatively large range of frequencies. Therefore, the range of dimensions is relatively large. It is not unusual for the resonant frequency of the largest element in a log-periodic array to be one-half of the resonant frequency of the smallest element. One result of this is that if one tried to achieve that range of resonant frequencies with a constant height, it would be likely that the appropriate height of the largest double-lemniscate antenna element in the array for a desirable radiation pattern at the lower frequencies would be larger than the perimeter of the loops of the smallest element. Hence, such an equal-height array would be practicable only if the range of frequencies covered were not very large.

Another reason for the problem is that all of the individual double-lemniscate antenna elements are connected in a log-periodic array. Therefore, the relationship between the impedances of the elements is important. The problem of equal-height log-periodic designs is that the impedances of high and narrow double-lemniscate antenna elements are quite different from the impedances of short and wide versions. The design of the connecting system, which depends on those impedances, might be unduly complicated if these unequal impedances were taken into account. In addition, the design might be complicated by the fact that the radiation pattern would change if the ratio of the height to width were changed. Therefore, instead of using equal heights, it may be preferable to accept the poorer gain and poorer reduction of radiation to the rear resulting from the nonaligned conductors in order to use double-lemniscate antenna elements that are proportional to each other in height and width.

Sometimes, a compromise between the extremes of equal height and proportional dimensions is useful. For example, the resonant frequencies of adjacent double-lemniscate antenna elements may conform to a constant ratio, the conventional scale factor, but the heights may conform to some other ratio, such as the square root of the scale factor.

Applications—Log-Periodic Design

Whether equal-height double-lemniscate antenna elements or proportional dimensions are used, the design principles are similar to the traditional principles of log-periodic dipole arrays. However, the details would be different in some ways. The scale factor ($\tau$) and spacing factor ($\sigma$) usually are defined in terms of the dipole lengths, but there would be no such lengths available if the individual elements were not half-wave dipoles. It is better to interpret the scale factor as the ratio of the resonant wavelengths of adjacent double-lemniscate antenna elements. If the design were proportional, that also would be the ratio of any corresponding dimensions in the adjacent elements. For example, for the proportional array of FIG. 15, the scale factor would be the ratio of any dimension of the second largest element formed by parts 1541 to 1550 divided by the corresponding dimension of the largest element formed by parts 1551 to 1560. The spacing factor could be interpreted as the ratio of the individual space to the resonant wavelength of the larger of the two double-lemniscate antenna elements adjacent to that space. For example, the spacing factor would be the ratio of the space between the two largest double-lemniscate antenna elements to the resonant wavelength of the largest element.

Some other standard factors may need more than reinterpretation. For example, since the impedances of double-lemniscate antenna elements do not equal the impedances of dipoles, the usual impedance calculations for log-periodic dipole antennas are not very useful. Also, since the array uses some double-lemniscate antenna elements that are larger and some that are smaller than resonant elements at any particular operating frequency, the design must be extended to frequencies beyond the operating frequencies. For log-periodic dipole antennas, this is done by calculating a bandwidth of the active region, but there is no such calculation available for the double-lemniscate log-periodic array. Since the criteria used for determining this bandwidth of the active region were quite arbitrary, this bandwidth may not have satisfied all uses of log-periodic dipole antennas either.

However, if the array had a constant scale factor and a constant spacing factor, the elements were connected with a transmission line having a velocity of propagation near the speed of light, like open wire, and the connections were reversed between each pair of elements, the result would be some kind of log-periodic array. In FIG. 15, that transmission line is formed by the two feeder conductors 1573 and 1574. The connection reversal is achieved by alternately connecting the left and right sides of the central conductors to the top and bottom feeder conductors. For example, the left side of the largest element, 1551, is connected to the bottom feeder conductor, 1574, but the left side of the second largest element, 1541, is connected to the top feeder conductor, 1573. The frequency range, the impedance, and the gain of such an array may not be what the particular application requires, but nevertheless it will be a log-periodic array. The task is just to start with a reasonable trial design and to make adjustments to achieve an acceptable design.

This approach is practicable because computer programs allow us to test antennas before they exist. No longer is it necessary to be able to calculate the dimensions with reasonable accuracy because of the cost of building real antennas. Instead, the trial dimensions could be put into a computer spreadsheet, so that the mechanical results of changes could be seen almost instantly. If the results of those mechanical calculations seemed promising, an antenna simulating program could show whether the design were electrically acceptable to a reasonable degree of accuracy. Only after the computer testing had produced a reasonable design, would it be necessary to build real antennas for testing on the antenna range.

To get a trial log-periodic design, the procedure could be as follows. The known specifications would be the band of frequencies to be covered, the desired gain, the desired reduction of radiation to the rear, the desired length of the array, and the number of antenna elements that could be tolerated because of the weight and cost. Since the resonant frequencies of the largest and smallest double-lemniscate antenna elements could not be calculated, it would be necessary just to choose a pair of frequencies that would be reasonably beyond the actual operating frequencies. Then, given the minimum frequency ($f_{min}$), maximum frequency ($f_{max}$) length (L), and number of elements (N), one could calculate the scale factor ($\tau$) and the spacing factor ($\sigma$) by using the geometry of the array.

$$\tau=(f_{min}/f_{max})^{[1/(N-)]}$$

The calculation of a requires the calculation of the wavelength of the largest double-lemniscate antenna element. Of course, this could be done in any units, but this maximum wavelength and the length of the array must be in the same units.

$$\lambda_{max}=9.84\times10^{8}/f_{min}ft$$

or $$\lambda_{max}=3\times10^{8}/f_{min}m$$

$$\sigma=[L(1-\tau)][\lambda_{max}(1-f_{min}/f_{max})]$$

Once a mechanical design was revealed by these calculations, it would be tested for electrical performance by an antenna simulating program. The largest double-lemniscate antenna element would be designed using the maximum wavelength ($\lambda_{max}$) Then, for a proportional design, the resonant wavelengths and dimensions of the remaining elements would be obtained by successively multiplying the wavelengths and the dimensions by the scale factor. The spaces between the elements would be obtained by multiplying the wavelength of the larger adjacent element by the spacing factor. An additional factor needed for the program would be the distance between the feeder conductors. For good operation this distance should produce a relatively high characteristic impedance. Unless the scale factor were rather high, a minimum characteristic impedance of 200 ohms perhaps would be prudent. Because the boom (1575) is a part of the feeding system in FIG. 15, that criterion would be at least 100 ohms between either feeder conductor and the boom.

The gain, front-to-back ratio, and standing wave ratio of this first trial design probably would indicate that the upper and lower frequencies were not acceptable. At least, the spacing between the feeder conductors probably should be modified to produce the best impedance across the band of operating frequencies. With this information, new values would be chosen to get a second trial design.

What is an acceptable performance is, of course, a matter of individual requirements and individual standards. For that reason, variations from the original recommended practice are common. For example, although the extension of the feeder conductors behind the largest element was recommended in early literature to improve the performance at the lowest frequency, it is seldom used. The original recommendation was that it should be about an eighth of a wavelength long at the lowest frequency and terminated in the characteristic impedance of the feeder conductors, which is represented by the resistance symbol 1576. It is more common practice to make the termination a short circuit. If the antenna were designed for proper operation, the conventional wisdom seems to be that the current in the termination would be very small anyway, so the termination would do very little and usually could be eliminated. However, there are some reports that the performance at twice the lowest frequency would be impaired if the extension were not used.

Actually, extending or not extending the feeder conductors may not be the significant choice. There may be a limit to the length of the antenna. In that case, the choice may be whether it is better to have an extension or more elements. Note that because the boom is a part of the feeding system in FIG. 15, it should be extended as well.

The log-periodic array of FIG. 15 illustrates the appropriate connecting points, F, to serve a balanced transmission line leading to the associated electronic equipment. Other tactics for feeding unbalanced loads and higher impedance balanced loads also are used with log-periodic dipole antennas. Because these tactics depend only on some kind of log-periodic array connected to two parallel tubes, these conventional tactics are as valid for such an array of double-lemniscate antenna elements as they are for such arrays of half-wave dipoles.

Applications—Large Arrays

Both Yagi-Uda arrays and log-periodic arrays of double-lemniscate antenna elements can be used in the ways that such arrays of half-wave dipoles are used. For example, FIG. 13 shows two end-fire arrays that are oriented to produce elliptically polarized radiation. For another example, FIG. 12 indicates that such arrays could be put into larger collinear or broadside arrays. Since the gain of such large arrays tends to depend on the overall area of the array facing the direction of maximum radiation, it is unrealistic to expect much of a gain advantage from using double-lemniscate antenna elements in large arrays of a particular overall size. However, there are other advantages. Since the individual arrays in the overall array could have more gain if they were composed of double-lemniscate antenna elements, the feeding system could be simpler because fewer individual arrays would be needed to fill the overall space adequately. In addition, the superior ability of the double-lemniscate antenna elements to reduce received signals arriving from undesired directions is a considerable advantage when the desired signals are small. For communication by reflecting signals off the moon, the ability to reduce undesired signals and noise is a great advantage.

It is well known that there is some minimum spacing needed between the individual antenna elements in collinear or broadside arrays so that the gain of the whole array will be maximized. If the beam width of the individual elements were narrow, that minimum spacing would be larger than if the beam width were wide. In other words, if the gain of the individual elements were large, the spacing between them should be large. Large spacing, of course, increases the cost and weight of the supporting structure.

Because the half-wave dipole has no directivity in the principal H plane, Yagi-Uda arrays of half-wave dipoles usually have wider beam widths in the principal H plane than in the principal E plane. Therefore, the spacing necessary to obtain the maximum gain from two such arrays would be less for a broadside array than for a collinear array. That is, for a horizontally polarized array, it would be better from a cost and weight point of view to place the two arrays one above the other instead of one beside the other. The double-lemniscate antenna element presents the opposite situation. Because the latter element produces considerable directivity in the principal H plane, a Yagi-Uda array of them would have a narrower beam in the principal H plane than in the principal E plane. Therefore, it would be better to place two such arrays in a collinear array instead of in a broadside array. Of course, mechanical or other considerations may make other choices preferable.

It also is unrealistic to expect that long Yagi-Uda arrays of double-lemniscate antenna elements will have a large gain advantage over long Yagi-Uda arrays of half-wave dipoles. The principle of a minimum necessary spacing applies here as well. It is not exactly true, but one can consider that the lemniscate antenna element is equal to two dipoles, represented by the outer rounded ends of the curves, joined by the parts of the curves leading to the central acute angles. Therefore, because the lemniscate acts somewhat like two dipoles, a Yagi-Uda array of them could be regarded as two Yagi-Uda arrays of dipoles. Likewise, the double-lemniscate antenna element could be regarded as equal to two dipoles at the outer points and one dipole at the center. Therefore, because the double-lemniscate antenna element acts somewhat like three parallel dipoles, a Yagi-Uda array of double-lemniscate antenna elements could be regarded as three Yagi-Uda arrays of dipoles.

These three Yagi-Uda arrays each have some beam width in the principal H plane and, therefore, they should be separated by some minimum distance to produce the maximum gain for the combination. The longer the Yagi-Uda array is, of course, the narrower the individual H plane beams would be and the greater the spacing should be. That is, since the spacing is limited by the need to have loops with some particular perimeters, such as one-wavelength loops, a long Yagi-Uda array of double-lemniscate antenna elements would not have as much gain as one might expect. In particular, a very long array of such structures may not have much advantage at all over an array of half-wave dipoles of equal length.

That situation raises the question of how long Yagi-Uda arrays should be. One factor is that there usually is an advantage to making Yagi-Uda arrays of four lemniscate antennas elements, because four elements usually are required to produce an excellent reduction of the radiation to the rear of the array. Beyond that array length, the increase in gain for the increase in length probably will be disappointing because the distance between the parallel conductors cannot be increased very much. That is, the usual expectation that doubling the length producing twice the gain will not be realized. It probably would be wiser to employ more than one Yagi-Uda array of lemniscate antenna elements in a larger collinear or broadside array.

Because double-lemniscate antenna elements have more directivity in the principal H plane, a Yagi-Uda array of them can be longer before the advantage over a dipole array becomes too small. It depends on individual circumstances, but perhaps eight or ten double-lemniscate antenna elements in a Yagi-Uda array is a reasonable limit. Beyond that, it probably will be more profitable to use several Yagi-Uda arrays instead.

Except for the restrictions of size, weight, and cost, double-lemniscate antenna elements could be used for almost whatever purposes that antennas are used. Beside the obvious needs to communicate sound, pictures, data, etc., they also could be used for such purposes as radar or for detecting objects near them for security purposes. Because they are much larger than half-wave dipoles, it would be expected that they would generally not be used at the lower end of the high-frequency spectrum. However, they may not be considered to be too large for short-wave broadcasting because that service typically uses very large antennas.

While this invention has been described in detail, it is not restricted to the exact embodiments shown. These embodiments serve to illustrate some of the possible applications of the invention rather than to define the limitations of the invention.

I claim:

1. An antenna element, comprising two pairs of conducting loops that are disposed approximately in a plane and that have perimeters of approximately one wavelength to two wavelengths of operation, such that:

(a) each of said pairs of conducting loops has a point of reference;

(b) in each of said pairs of conducting loops, the distance from said point of reference to any point x on each of said conducting loops is approximately equal to the expression $$r=h|\cos(m\theta)|^p$$

wherein r is said distance from said point of reference to said point x on each of said conducting loops, h is the maximum value of r, m is a positive number greater than one, p is a non-negative number, θ is the angle in said plane between an imaginary straight line from said point of reference to said point x on each of said conducting loops and an imaginary straight line that passes through said points of reference of said two pairs of conducting loops, for a first one of said conducting loops, θ has values that start at approximately $-\pi/2m$ radians and end at approximately $\pi/2m$ radians, and for the remaining second one of said conducting loops, θ has values that start at approximately $(\pi-\pi/2m)$ radians and end at approximately $(\pi+\pi/2m)$ radians;

(c) in each of said pairs of conducting loops, a first conductor end of said first one of said conducting loops is connected to a first conductor end of said second one of said conducting loops, and the remaining second conductor ends are connected to each other, but there is no direct connection between these two pairs of conductor ends;

(d) for the two inner conducting loops, h is the distance that is approximately one-half of the distance between said two points of reference, thereby connecting said two pairs of conducting loops at the proximal point of said antenna element; and (e) there is a means for connecting the associated electronic equipment effectively in series with said two inner conducting loops, approximately at said proximal point of said antenna element.

2. The antenna element of claim 1 wherein:

(a) the perimeters of said conducting loops are approximately one wavelength of operation; and (b) in each of said pairs of conducting loops, the conductor ends for $\theta$ approximately equaling $-\pi/2m$ and $\pi-\pi/2m$ radians are connected and the conductor ends for $\theta$ approximately equaling $\pi/2m$ and $\pi+\pi/2m$ radians are connected.

3. The antenna element of claim 1 wherein:

(a) the perimeters of said conducting loops are approximately one and one-half to two wavelengths of operation; and (b) in each of said pairs of conducting loops, the conductor ends for $\theta$ approximately equaling $-\pi/2m$ and $\pi+\pi/2m$ radians are connected and the conductor ends for $\theta$ approximately equaling $\pi/2m$ and $\pi-\pi/2m$ radians are connected.

4. The antenna element of claim 1 wherein in each of said pairs of conducting loops, the values of h, m and p for said inner conducting loops approximately equal said values for the outer conducting loops.

5. The antenna element of claim 1 wherein in each of said pairs of conducting loops, the values of at least one of h, m or p for said inner conducting loops do not equal said values for the outer conducting loops.

6. The antenna element of claim 1 wherein the value of p approximately equals zero for at least one of said conducting loops.

7. The antenna element of claim 1 wherein the dimensions of said antenna element are chosen to maximize the transmitting and receiving ability of said antenna element in the direction perpendicular to said plane of said antenna element.

8. The antenna element of claim 1 wherein the dimensions of said antenna element are chosen to minimize the transmitting and receiving ability of said antenna element in the two directions, in said plane of said antenna element, that are parallel to said imaginary straight line that passes through said points of reference.

9. The antenna element of claim 1 wherein the dimensions of said antenna element are chosen to produce a beneficial compromise between maximizing the transmitting and receiving ability of said antenna element in the direction perpendicular to said plane of said antenna element and minimizing said transmitting and receiving ability in other directions.

10. The antenna element of claim 1 wherein at least one of the conductors has a circular cross-sectional area.

11. The antenna element of claim 1 wherein at least one of the conductors has a solid cross-sectional area.

12. The antenna element of claim 1 wherein at least one of the conductors has a tubular cross-sectional area.

13. The antenna element of claim 1 wherein the conductors have equal cross-sectional areas.

14. The antenna element of claim 1 wherein not all of the conductors have equal cross-sectional areas.

15. The antenna element of claim 1, further including two approximately straight strengthening conductors connected between said proximal point and each of the distal points on said conducting loops, but that do not connect to said conducting loops at said points of reference.

16. The antenna element of claim 15 wherein said strengthening conductors are grounded.

17. The antenna element of claim 1 wherein the principal H plane is disposed approximately parallel to the ground.

18. The antenna element of claim 1 wherein the principal H plane is disposed approximately perpendicular to the ground.

19. The antenna element of claim 1 wherein the principal H plane is disposed neither approximately parallel to the ground nor approximately perpendicular to the ground.

20. An antenna comprising two interconnected antenna elements, each of said antenna elements comprising two pairs of conducting loops that are disposed approximately in a plane and that have perimeters of approximately one wavelength of operation, such that:

(a) said planes of said antenna elements are approximately parallel to each other;

(b) the perpendicular distance between said planes is much less than the wavelength of operation;

(c) each of said pairs of conducting loops has a point of reference;

(d) in each of said pairs of conducting loops of each of said antenna elements, the distance from said point of reference to any point x on each of said conducting loops is approximately equal to the expression $$r=h|\cos(m\theta)|^p$$

wherein r is said distance from said point of reference to said point x on each of said conducting loops, h is the maximum value of r, m is a positive number greater than one, p is a non-negative number, $\theta$ is the angle in said plane between an imaginary straight line from said point of reference to said point x on each of said conducting loops and an imaginary straight line that passes between said points of reference of said two pairs of conducting loops, for a first one of said conducting loops, $\theta$ has values that start at approximately $-\pi/2m$ radians and end at approximately $\pi/2m$ radians, and for the remaining second one of said conducting loops, $\theta$ has values that start at approximately $(\pi-\pi/2m)$ radians and end at approximately $(\pi+\pi/2m)$ radians;

(e) said imaginary straight lines that pass between said points of reference in said two antenna elements are approximately equal in length and are approximately parallel to each other;

(f) an imaginary straight line from a point of reference in a first one of said antenna elements to the corresponding point of reference in the second one of said antenna elements is approximately perpendicular to said planes of said antenna elements;

(g) in each of said pairs of conducting loops, the conductor ends for $\theta$ approximately equaling $-\pi/2m$ and $\pi-\pi/2m$ radians are connected at a first point of origin and the conductor ends for $\theta$ approximately equaling $\pi/2m$ and $\pi+\pi/2m$ radians are connected at a second point of origin, but there is no direct connection between these two points of origin;

(h) in each of said pairs of conducting loops, said two points of origin are separated from each other and separated from said point of reference by distances that are much less than said perpendicular distance between said planes;

(i) in each of said antenna elements, the inner conducting loops have values of h that are approximately one-half of the distance between said points of reference, thereby connecting said conducting loops at the proximal points of each of said antenna elements;

(j) in each of said antenna elements, said inner conducting loops begin at said first point of origin and end at said second point of origin of the same antenna element;

(k) two outer conducting loops begin at said first points of origin of said first antenna element and end at said second points of origin of said second antenna element;

(l) two more outer conducting loops begin at said second points of origin of said first antenna element and end at said first points or origin of said second antenna element;

(m) at the distal points of said antenna elements, said outer conducting loops cross but do not touch each other; and (n) there is a means for connecting the associated electronic equipment effectively in series with said inner conducting loops, and approximately at the proximal point of one of said two antenna elements, so that, on said conducting loops, current maxima are present approximately at said distal points, approximately at said proximal points, and approximately at said points of origin, and single current minima are present between said current maxima.

21. An antenna system comprising at least one antenna, each of said antennas comprising at least two antenna elements, such that:

(a) each of said antenna elements comprises two pairs of conducting loops that are disposed approximately in a plane and that have perimeters of approximately one wavelength to two wavelengths of operation;

(b) each of said pairs of conducting loops has a point of reference;

(c) in each of said pairs of conducting loops, the distance from said point of reference to any point x on each of said conducting loops is approximately equal to the expression $$r=h|\cos(m\theta)|^p$$

wherein r is said distance from said point of reference to said point x on each of said conducting loops, h is the maximum value of r, m is a positive number greater than one, p is a non-negative number, θ is the angle in said plane between an imaginary straight line from said point of reference to said point x on each of said conducting loops and an imaginary straight line that passes through said points of reference of said two pairs of conducting loops, for a first one of said conducting loops, θ has values that start at approximately $-\pi/2m$ radians and end at approximately $\pi/2m$ radians, and for the remaining second one of said conducting loops, θ has values that start at approximately $(\pi-\pi/2m)$ radians and end at approximately $(\pi+\pi/2m)$ radians;

(d) in each of said pairs of conducting loops, a first conductor end of said first one of said conducting loops is connected to a first conductor end of said second one of said conducting loops, and the remaining second conductor ends are connected to each other, but there is no direct connection between these two pairs of conductor ends;

(e) for the two inner conducting loops in each of said antenna elements, h is the distance that is approximately one-half of the distance between said two points of reference, thereby connecting said two pairs of conducting loops at the proximal point of said antenna element;

(f) in each of said antennas, said planes of said antenna elements are positioned so that the angles between said planes approximately equally divide a circle of 360 degrees;

(g) in each of said antennas, the intersection of said planes forms a line that passes much closer to said proximal points of said antenna elements than the length of a wavelength of operation and passes much closer to the distal points of said antenna elements than the length of a wavelength of operation;

(h) in each of said antennas, except perhaps at said proximal points and at said distal points, said antenna elements do not touch each other;

(i) in each of said antenna elements, means is provided for connecting the associated electronic equipment effectively in series with said two inner conducting loops, approximately at said proximal point of said antenna element; and (j) in each of said antennas, said means also is such that the currents at corresponding points on said antenna elements are consistently related in amplitude by approximately equal ratios of values and are consistently unequal in phase by approximately equal amounts.

22. The antenna system of claim 21 wherein:

(a) there are just two of said antenna elements in each of said antennas;

(b) said angles between said planes of said antenna elements are approximately 90 degrees; and (c) the amplitudes of said currents at said corresponding points of said two antenna elements, of each of said antennas, are approximately equal and the phases of said currents are consistently unequal by approximately 90 degrees.

23. The antenna system of claim 21 wherein:

(a) there are just three of said antenna elements in each of said antennas;

(b) said angles between said planes of said antenna elements are approximately 60 degrees;

(c) said means of connecting said antenna elements to said associated electronic equipment also is such that the currents at said corresponding points on said antenna elements are approximately equal in amplitude; and (d) said connecting means is also such that, progressing around the center line of each of said antennas in one particular direction, the pattern of the phases of the currents at said corresponding points on said antenna elements is approximately 0, 60, 120, 180, 240 and 300 degrees.

24. The antenna system of claim 21 wherein there is only one antenna.

25. The antenna system of claim 21 wherein:

(a) there is more than one of said antennas in said antenna system; and (b) said antennas are aligned so that the line of intersection of said planes of each of said antennas approximately is the line of intersection of said planes of the other antennas in said antenna system.

26. The antenna system of claim 25 wherein the relative amplitudes and phases of said currents at corresponding points of said antennas and the distances between said antennas are such that the transmitting and receiving ability is maximized in the principal E plane.

27. The antenna system of claim 25 wherein the relative amplitudes and phases of said currents at corresponding points of said antennas and the distances between said antennas are such that the transmitting and receiving ability is minimized in directions other than in the principal E plane.

28. The antenna system of claim 25 wherein the relative amplitudes and phases of said currents at corresponding points of said antennas and the distances between said antennas are such that the transmitting and receiving ability is a beneficial compromise between maximizing said transmitting and receiving ability in the principal E plane and minimizing said transmitting and receiving ability in other directions.

29. An antenna system comprising at least one antenna, each of said antennas comprising at least one antenna element, such that:

(a) each of said antenna elements comprises two pairs of conducting loops that are disposed approximately in a plane and that have perimeters of approximately one wavelength to two wavelengths of operation;

(b) each of said pairs of conducting loops has a point of reference;

(c) in each of said pairs of conducting loops, the distance from said point of reference to any point x on each of said conducting loops is approximately equal to the expression $$r=h|\cos(m\theta)|^p$$

wherein r is said distance from said point of reference to said point x on each of said conducting loops, h is the maximum value of r, m is a positive number greater than one, p is a non-negative number, θ is the angle in said plane between an imaginary straight line from said point of reference to said point x on each of said conducting loops and an imaginary straight line that passes through said points of reference of said two pairs of conducting loops, for a first one of said conducting loops, θ has values that start at approximately $-\pi/2m$ radians and end at approximately $\pi/2$ m radians, and for the remaining second one of said conducting loops, θ has values that start at approximately $(\pi-\pi/2m)$ radians and end at approximately $(\pi+\pi/2m)$ radians;

(d) in each of said pairs of conducting loops, a first conductor end of said first one of said conducting loops is connected to a first conductor end of said second one of said conducting loops, and the remaining second conductor ends are connected to each other, but there is no direct connection between these two pairs of conductor ends;

(e) for the two inner conducting loops in each of said antenna elements, h is the distance that is approximately one-half of the distance between said two points of reference, thereby connecting said two pairs of conducting loops at the proximal point of said antenna element;

(f) within each of said antennas, said antenna elements are disposed in planes approximately parallel to each other;

(g) within each of said antennas, said antenna elements are disposed so that their principal H planes are approximately parallel to each other;

(h) within each of said antennas, said proximal points of said antenna elements are approximately aligned in the direction perpendicular to said planes of said antenna elements; and (i) means is provided for connecting the associated electronic equipment effectively in series with said two inner conducting loops, approximately at said proximal point of at least one of said antenna elements.

30. The antenna system of claim 29, further including a reflecting screen disposed behind said antenna system to produce a substantially unidirectional transmitting and receiving ability to the front of said antenna system in the direction approximately perpendicular to said planes of said antenna elements.

31. The antenna system of claim 29 wherein there is only one of said antennas in said antenna system.

32. The antenna system of claim 29 wherein there is more than one antenna in said antenna system.

33. The antenna system of claim 32 wherein:

(a) said antenna elements, of all of said antennas, are disposed so that their principal H planes are approximately parallel to each other; and (b) said antennas are approximately aligned in the direction parallel to the planes of said antenna elements and perpendicular to said principal H planes of said antenna elements.

34. The antenna system of claim 32 wherein:

(a) said antenna elements, of all of said antennas, are disposed so that their principal H planes are approximately parallel to each other; and (b) said antennas are approximately aligned in the direction parallel to the planes of said antenna elements and parallel to said principal H planes of said antenna elements.

35. The antenna system of claim 32 wherein:

(a) said antenna elements, of all of said antennas, are disposed so that their principal H planes are approximately parallel to each other; and (b) said antennas are approximately aligned in the direction parallel to the planes of said antenna elements and aligned both in the direction parallel to and in the direction perpendicular to said principal H planes of said antenna elements, thereby producing a rectangular antenna system.

36. The antenna system of claim 32 wherein the relative amplitude and phase of the currents in said antennas and the distances between said antennas are chosen to maximize the transmitting and receiving ability to the front of said antenna system.

37. The antenna system of claim 32 wherein the relative amplitude and phase of the currents in said antennas and the distances between said antennas are chosen to minimize the transmitting and receiving ability in directions other than to the front of said antenna system.

38. The antenna system of claim 32 wherein the relative amplitude and phase of the currents in said antennas and the distances between said antennas are chosen to produce a beneficial compromise between maximizing the transmitting and receiving ability to the front of said antenna system and minimizing said transmitting and receiving ability in other directions.

39. The antenna system of claim 29 wherein there is only one of said antenna elements in each of said antennas.

40. The antenna system of claim 29 wherein there is more than one of said antenna elements in each of said antennas.

41. The antenna system of claim 40 wherein in each of said antennas:

(a) there are just two of said antenna elements, with substantially equal dimensions;

(b) both of said antenna elements are connected to said associated electronic equipment; and (c) said means of connection to said associated electronic equipment also is such that the currents in corresponding conductors of said two antenna elements are approximately equal in amplitude and approximately 180 degrees out of phase with each other.

42. The antenna system of claim 40 wherein in each of said antennas:

(a) there are just two of said antenna elements, with substantially equal dimensions;

(b) both of said antenna elements are connected to said associated electronic equipment;

(c) said means of connection to said associated electronic equipment also is such that the currents in corresponding conductors of said two antenna elements are approximately equal in amplitude; and (d) the distance between said antenna elements and the phase difference between said currents in said corresponding conductors are such that the radiation is minimized in one of the two directions perpendicular to said planes of said antenna elements.

43. The antenna system of claim 42 wherein in each of said antennas:

(a) the distance between said antenna elements is approximately a free-space quarter wavelength of operation; and (b) the phase difference between said currents in said corresponding conductors is approximately a consistent 90 degrees.

44. The antenna system of claim 40 wherein in each of said antennas:

(a) there are just two antenna elements in each of said antennas;

(b) only the rear antenna elements are connected to said associated electronic equipment; and (c) the dimensions of said antenna elements and the distances between said antenna elements are such that the transmitting and receiving ability is substantially unidirectional to the front of said antenna system.

45. The antenna system of claim 40 wherein:

(a) there is an even number of said antennas in said antenna system; and (b) said antennas are substantially the same as each other in the dimensions of their antenna elements and the distances between their antenna elements.

46. The antenna system of claim 45 wherein:

(a) a first half of said antennas has its principal H planes oriented approximately perpendicular to the principal H planes of the remaining second half of said antennas;

(b) said antennas are disposed in pairs, each of said pairs comprising said antennas having principal H planes of the two orientations;

(c) said antennas also are disposed so that said proximal points of the corresponding antenna elements, in each of said pairs, are much closer to each other than the length of a wavelength of operation; and (d) said means of connection to said associated electronic equipment also is such that the currents in the conductors of said first half of said antennas are approximately equal in amplitude and consistently out of phase by approximately 90 degrees to the currents in the corresponding conductors of said second half of said antennas, thereby producing an approximately circularly polarized antenna system.

47. The antenna system of claim 45 wherein:

(a) a first half of said antennas has principal H planes that are oriented approximately perpendicular to the principal H planes of the remaining second half of said antennas;

(b) said antennas are disposed in pairs, each of said pairs comprising said antennas having principal H planes of the two orientations;

(c) said proximal points of said antenna elements, in both of said antennas in each of said pairs, are approximately aligned with each other;

(d) said means of connection to said associated electronic equipment also is such that the currents in corresponding conductors, in each of said pairs, are approximately equal in amplitude; and (e) the perpendicular distances between said planes of the corresponding antenna elements, in each of said pairs of said antennas, and the phase relationship between the corresponding currents, in each of said pairs of antennas, are such that approximately circularly polarized radiation is produced to the front of said antenna system.

48. The antenna system of claim 40 wherein:

(a) only the second antenna element from the rear of each of said antennas is connected to said associated electronic equipment; and (b) in each of said antennas, the dimensions of said antenna elements and the distances between said antenna elements are such that the transmitting and receiving ability is substantially unidirectional to the front of said antenna system.

49. The antenna system of claim 48 wherein the dimensions of said antenna elements and the distances between said antenna elements produce the maximum transmitting and receiving ability in the direction to the front of said antenna system.

50. The antenna system of claim 48 wherein the dimensions of said antenna elements and the distances between said antenna elements produce the minimum transmitting and receiving ability in directions other than in the direction to the front of said antenna system.

51. The antenna system of claim 48 wherein the dimensions of said antenna elements and the distances between said antenna elements produce a beneficial compromise between maximizing the transmitting and receiving ability in the direction to the front of said antenna system and minimizing said transmitting and receiving ability in other directions.

52. The antenna element of claim 40 wherein:

(a) the perimeters of the loops are approximately one wavelength of operation; and (b) in each of said pairs of conducting loops, the conductor ends for $\theta$ approximately equaling $-\pi/2m$ and $\pi-\pi/2m$ radians are connected and the conductor ends for $\theta$ approximately equaling $\pi/2m$ and $\pi+\pi/2m$ radians are connected.

53. The antenna system of claim 52 wherein:

(a) the resonant frequencies of said antenna elements are progressively and proportionally higher from the rear to the front of each of said antennas;

(b) the distances between said antenna elements are progressively and proportionally shorter from the rear to the front of each of said antennas;

(c) within each of said antennas, the ratio of said resonant frequencies of all the adjacent antenna elements and the ratio of all the adjacent distances between said antenna elements are approximately equal ratios;

(d) within each of said antennas, all of said antenna elements are connected to each other, effectively at said proximal points, so that the phase relationship produced by the time taken for the energy to travel between said antenna elements, by that connection, is substantially equal to the phase relationship that is consistent with travel at the speed of light;

(e) said connection between said antenna elements also produces, in addition to the phase difference caused by the travelling time of the energy, an additional phase reversal between said adjacent antenna elements; and (f) the antenna elements at the front of each of said antennas are connected to said associated electronic equipment.

54. The antenna system of claim 53 wherein the differences in said resonant frequencies are caused by all the dimensions of said antenna elements approximately being proportionally different.

55. The antenna system of claim 53 wherein:

(a) the heights of each of said antenna elements are all approximately equal; and (b) the differences in said resonant frequencies are caused by the widths of said antenna elements being different.

56. The antenna system of claim 53 wherein the method of producing said proportional resonant frequencies is a compromise between having all the dimensions of said antenna elements proportional to each other and having equal heights in each of said antenna elements.

57. An antenna element, comprising two pairs of conducting loops that are disposed approximately in a plane and that have perimeters of approximately one wavelength to two wavelengths of operation, such that:

(a) each of said pairs of conducting loops has a point of reference;

(b) in each of said pairs of conducting loops, the distance from said point of reference to any point x on the outer conducting loops is approximately equal to the expression $$r=h|\cos(m\theta)|^p$$

wherein r is said distance from said point of reference to said point x on each of said outer conducting loops,
h is the maximum value of r,
m is a positive number greater than one,
p is a non-negative number, and
θ is the angle in said plane between an imaginary straight line from said point of reference to said point x on each of said outer conducting loops and an imaginary straight line that passes through said points of reference of said two pairs of conducting loops;

(c) for a first one of said outer conducting loops, θ has values that start at approximately $-\pi/2m$ radians and end at approximately $\pi/2m$ radians;

(d) for the remaining second one of said outer conducting loops, θ has values that start at approximately $(\pi-\pi/2m)$ radians and end at approximately $(\pi+\pi/2m)$ radians;

(e) approximately at each of said points of reference there are two points of origin that are separated from each other and separated from said points of reference by distances that are much less than the wavelength of operation;

(f) each of the two conductor ends of each of said outer conducting loops is connected to one of said points of origin;

(g) half way between said points of reference, an approximately straight proximal conductor is disposed perpendicular to and symmetrically with respect to said imaginary straight line that passes through said points of reference;

(h) two approximately straight diagonal conductors are disposed from each end of said approximately straight proximal conductor so that these four diagonal conductors are connected to the four points of origin to form the two inner conducting loops; and (i) means is provided for connecting the associated electronic equipment effectively at the center of said approximately straight proximal conductor.

58. The antenna element of claim 57 wherein:

(a) the perimeters of said conducting loops are approximately one wavelength of operation; and (b) the connections between said conducting loops are such that the conductors cross but do not touch at said points of origin.

59. The antenna element of claim 57 wherein:

(a) the perimeters of said conducting loops are approximately one and one-half to two wavelengths of operation; and (b) the connections between said conducting loops are such that the conductors do not cross and do not touch at said points of origin.

* * * * *

UNITED STATES PATENT AND TRADEMARK OFFICE

CERTIFICATE OF CORRECTION

PATENT NO. : 6,469,674 B1
DATED : October 22, 2002
INVENTOR(S) : James Stanely Podger It is certified that error appears in the above-identified patent and that said Letters Patent is hereby corrected as shown below:

Column 3,
Line 46, replace "power)" with -- power ($p$) --.
Line 54, the symbol $p$ should be a superscript.
Line 59, delete one set of "$<\theta$".

Column 6,
Line 48, replace "low-in" with -- low-gain --.

Column 19,
Line 39, replace "of a" with -- of $\sigma$ --.

Column 27,
Line 32, between ")" and "$^{p}$" add -- | --.

Column 32,
Line 45, between ")" and "$^{p}$" add -- | --.

Signed and Sealed this

Eighteenth Day of February, 2003

JAMES E. ROGAN
*Director of the United States Patent and Trademark Office*